US012188348B2

(12) United States Patent
Thiruvenkatanathan

(10) Patent No.: US 12,188,348 B2
(45) Date of Patent: Jan. 7, 2025

(54) DETECTING FLOW OBSTRUCTION EVENTS WITHIN A FLOW LINE USING ACOUSTIC FREQUENCY DOMAIN FEATURES

(71) Applicant: LYTT LIMITED, Middlesex (GB)

(72) Inventor: Pradyumna Thiruvenkatanathan, London (GB)

(73) Assignee: LYTT LIMITED, Middlesex (GB)

( * ) Notice: Subject to any disclaimer, the term of this patent is extended or adjusted under 35 U.S.C. 154(b) by 161 days.

(21) Appl. No.: 17/793,058

(22) PCT Filed: Jan. 24, 2020

(86) PCT No.: PCT/EP2020/051814

§ 371 (c)(1),
(2) Date: Jul. 15, 2022

(87) PCT Pub. No.: WO2021/148141

PCT Pub. Date: Jul. 29, 2021

(65) Prior Publication Data

US 2023/0043381 A1 Feb. 9, 2023

(51) Int. Cl.
*E21B 47/095* (2012.01)
*E21B 47/107* (2012.01)

(52) U.S. Cl.
CPC ..... *E21B 47/095* (2020.05); *E21B 47/107* (2020.05); *E21B 2200/20* (2020.05); *E21B 2200/22* (2020.05)

(58) Field of Classification Search
CPC .. E21B 47/095; E21B 47/107; E21B 2200/20; E21B 2200/22; E21B 47/06; E21B 47/09
See application file for complete search history.

(56) References Cited

U.S. PATENT DOCUMENTS

| | | | | |
|---|---|---|---|---|
| 2006/0165344 | A1 | 7/2006 | Mendez et al. | |
| 2011/0139538 | A1 | 6/2011 | Hill et al. | |
| 2013/0021874 | A1* | 1/2013 | Hartog | G01V 1/226 367/31 |
| 2013/0167628 | A1* | 7/2013 | Hull | E21B 47/107 73/152.58 |
| 2021/0190665 | A1* | 6/2021 | Bennett | B08B 9/027 |
| 2021/0357557 | A1* | 11/2021 | Jagannathan | E21B 47/085 |
| 2023/0043381 | A1* | 2/2023 | Thiruvenkatanathan | E21B 47/107 |

FOREIGN PATENT DOCUMENTS

| | | | |
|---|---|---|---|
| CN | 209858753 | U | 12/2019 |
| WO | 2019/094474 | A1 | 5/2019 |

OTHER PUBLICATIONS

PCT/EP2020/051814 International Search Report and Written Opinion dated Dec. 11, 2020 (18 p.).

* cited by examiner

*Primary Examiner* — Daniel P Stephenson
(74) *Attorney, Agent, or Firm* — CONLEY ROSE, P.C.

(57) ABSTRACT

A monitoring system includes a flow line, an optical fiber coupled to the flow line, and a receiver coupled to an end of the optical fiber. The receiver is configured to detect at least one acoustic signal from the optical fiber. In addition, the monitoring system includes processor unit to detect a flow obstruction within the flow line based on the acoustic signal.

17 Claims, 7 Drawing Sheets

DETECTING FLOW OBSTRUCTION EVENTS WITHIN A FLOW LINE USING ACOUSTIC FREQUENCY DOMAIN FEATURES

CROSS-REFERENCE TO RELATED APPLICATIONS

This application is a 35 U.S.C. § 371 national stage application of PCT/EP2020/051814 filed Jan. 24, 2020 and entitled "Detecting Flow Obstruction Events Within a Flow Line Using Acoustic Frequency Domain Features," which is hereby incorporated herein by reference in its entirety for all purposes.

STATEMENT REGARDING FEDERALLY SPONSORED RESEARCH OR DEVELOPMENT

Not applicable.

BACKGROUND

Within a hydrocarbon production well, various fluids such as hydrocarbons, water, gas, and the like can be produced from the formation into a wellbore. From the wellbore, the fluids can be transported through several flow lines and processing points to a central plant. The production of the fluid can result in the movement of the fluids in various downhole regions. For example, some subterranean formations can release solid particulates, also referred to as "sand" or "particulates," that can be produced along with the fluids flow through the wellbore and the flow lines of the production line. In some situations, "particulates" within a production fluid may include waxes, hydrates, asphaltene, etc. and other components that can lead to the formation of plugs or blockages. These particulates and components can cause a number of problems including erosion (also referred to herein as wearing or sanding) of the flow lines, contamination and damage of the equipment, plugging, and the like.

BRIEF SUMMARY

In some embodiments, a monitoring system comprises: a flow line; an optical fiber coupled to the flow line; a receiver coupled to an end of the optical fiber, and a processor unit. The receiver is configured to detect an acoustic signal from the optical fiber. The processor unit comprises a processor and a memory, and the processor unit is adapted for signal communication with the receiver. The memory comprises an analysis application, that when executed on the processor, configures the processor to: receive, from the receiver, the acoustic signal that is created by a fluid within the flow line, detect a flow obstruction within the flow line based on the plurality of frequency domain features; and generate an output of the flow obstruction detection. The acoustic signal comprises a plurality of frequency domain features that are indicative of the acoustic signal across a frequency spectrum;

In some embodiments, a method of detecting a flow obstruction in a flow line comprises: generating an acoustic signal within a flow line, detecting the acoustic signal using an optical fiber coupled to the flow line; determining a plurality of frequency domain features from the acoustic signal; and detecting the flow obstruction in the flow line using the plurality of frequency domain features. The acoustic signal is generated while a fluid is flowing within the flow line, and the acoustic signal is generated from the fluid encountering the flow obstruction within the flow line.

In some embodiments, a method of developing a model for detecting a flow obstruction within a flow line comprises: obtaining a plurality of reference data sets for a flow line, determining one or more frequency domain features from the reference data sets; and training a model using the one or more frequency domain features from at least a portion of the reference data sets. The plurality of reference data sets comprise acoustic data obtained across a frequency spectrum, and the acoustic data is obtained from one or more sensors coupled to at least a portion of the flow line. The plurality of reference data sets comprise at least one reference data set obtained when a flow obstruction is present within the flow line and at least one reference data set obtained when the flow obstruction is absent from the flow line. These and other features will be more clearly understood from the following detailed description taken in conjunction with the accompanying drawings and claims.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of the various embodiments, reference will now be made to the accompanying drawings in which.

DETAILED DESCRIPTION

Figure 1:
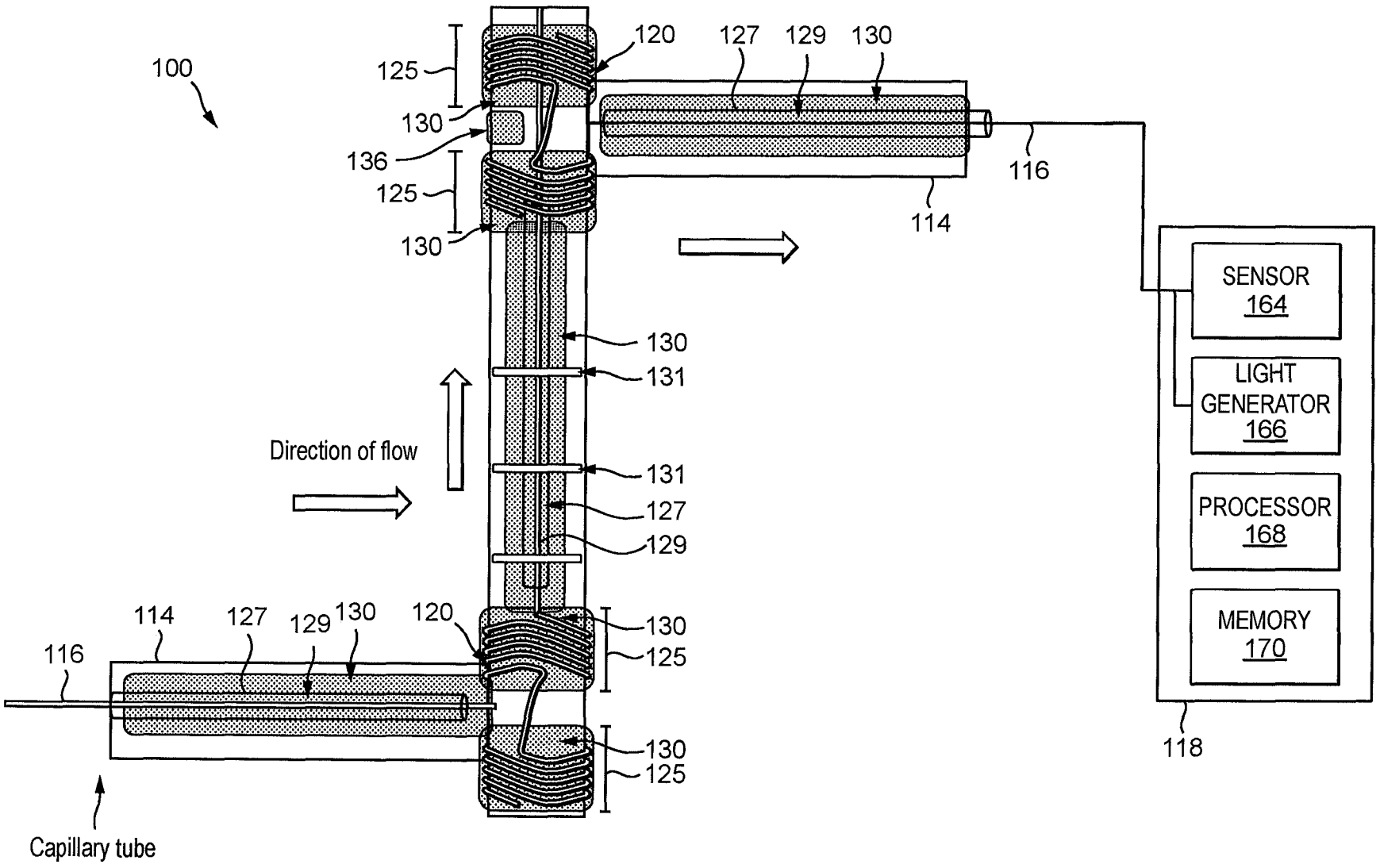
FIG. 1 is a schematic, cross-sectional illustration of monitoring system including a flow line having an attached optical fiber according to an embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to inner or outer will be made for purposes of description with "in," "inner," or "inward" meaning towards the central longitudinal axis of the flow line, and "out," "outer," or "outward" meaning towards the flow line wall. As used herein, the term "longitudinal" or "longitudinally" refers to an axis substantially aligned with the central axis of the flow line, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein is a new signal processing architecture that allows for the identification of various events that occur on a flow line, such as the presence of particulates (e.g., sand, etc.), plugs (e.g., formed from waxes, hydrates, etc.) forming an obstruction within the flow line, progression of a flow line pig or other device through the flow line, etc. In some embodiments, these events may be identified in real time or near real time.

Generally, the signal processing systems and methods disclosed herein may be used to detect flow obstruction events within a flow line. As used herein, the term "flow obstruction event" refers to situations where a fluid flow through a flow line is blocked or at least restricted by an obstruction (e.g., a blockage). A "flow obstruction" may comprise any single or collection of materials or devices that may block or at least restrict a flow through a flow line. The term "flow obstruction" specifically can include, for example, plugs, a deposit of components (e.g., sand, waxes, hydrates, asphaltene, etc.), a mechanical device (e.g., such as a flow line pig, tool, or other device), etc. As described in more detail below, the systems and methods disclosed herein may be utilized to detect flow obstruction event within a flow line. In addition, in some embodiments, the systems and methods disclosed herein may be utilized to track a changing location of a flow obstruction within a flow line (e.g., such as in the case when a flow obstruction comprises a flow line pig). As used herein, a "flow line pig" refers to a device or tool that is flowed or otherwise progressed through a flow line in order to perform one or more functions therein. For instance, in various scenarios, a flow line pig may be utilized to performing cleaning, clearing, inspection, maintenance or other operations and functions within a flow line. There is no desire to limit the potential functions or uses of a flow line pig via the descriptions herein, unless specifically stated otherwise.

As used herein, the term "real time" refers to a time that takes into account various communication and latency delays within a system, and can include actions taken within about ten seconds, within about thirty seconds, within about a minute, within about five minutes, or within about ten minutes of the action occurring. Various sensors (e.g., distributed fiber optic acoustic sensors, etc.) can be used to obtain an acoustic sampling at various points along the flow line. The acoustic sample can then be processed using signal processing architecture with various feature extraction techniques (e.g., spectral feature extraction techniques) to obtain a measure of one or more frequency domain features that enable selectively extracting the acoustic signals of interest from background noise and consequently aiding in improving the accuracy of the identification of the movement of fluids and/or solids (e.g., particulates passing through the bend of a flow line, etc.) in real time. As used herein, various frequency domain features can be obtained from the acoustic signal, and in some contexts the frequency domain features can also be referred to as spectral features or spectral descriptors.

The acoustic signal can be obtained in a manner that allows for a signal to be obtained along a flow line or a portion of interest of the flow line. While surface clamp-on acoustic detectors can be used at flow lines to detect acoustic signals, they do not provide information about a location of the flow line at which particulates are passing or a location of the flow at which erosion may be occurring. Further, the methodology adopted for processing the clamp-on detector data for identifying the events from other acoustic "background" noise have only yielded qualitative and often inconsistent results. A number of other technical limitations currently hinder direct application of the technology for real time flow line acoustic detection. Fiber optic distributed acoustic sensors (DAS) capture acoustic signals resulting from particulates or other flow obstructions (e.g., pigs, tools, etc.) passing along portions of a flow line and other background acoustics as well. This mandates the need for a robust signal processing procedure that distinguishes the acoustic signal generated from particulates passing through the flow line from other noise sources to avoid false positives in the results. This in turn results in a need for a clearer understanding of the acoustic fingerprint of flow line events of interest (e.g., flow obstruction events as previously described above) to be able to segregate a noise resulting from an event of interest from other ambient acoustic background noise. As used herein, the resulting acoustic fingerprint of a particular event (e.g., including a flow obstruction event) can also be referred to as a spectral signature, as described in more detail herein.

Traditional systems rely on manual inspections of locations exposed to fluids containing particulates, often requiring a system shutdown during the inspection. These manual inspections can result in significant production deferrals during the downtime. Reducing deferrals resulting from one or more events and facilitating effective remediation relies upon near-real time decision support to inform the operator of the events. There is currently no technology/signal processing for DAS that successfully distinguishes and extracts event locations, let alone in near real time.

The ability to identify various events in the flow line may allow for various actions to be taken in response to the events. For example, a flow line can be shut in, flow rates can be increased or decreased, and/or remedial measures can be taken in the flow line or wellbore, as appropriate based on the identified event(s). An effective response, when needed, benefits not just from a binary yes/no output of an identification of flow line events but also from a measure of relative amount of fluids and/or solids (e.g., solid particulates, etc.) passing through the identified portions of the flow line so that portions handling the greatest amount fluid and/or solid particulates can be acted upon first. For example, when a blockage is detected in the flow line, the production in the line and/or a bypass line can be adjusted to enable fluids to be conveyed within the system while addressing the cause of the blockage in the line.

As described herein, spectral descriptors can be used with DAS acoustic data processing in real time to provide various flow line surveillance applications. More specifically, the data processing techniques can be applied for various flow line fluid profiling such as fluid flow detection, fluid phase segregation, particulate presence, flow obstruction detection (e.g., flow obstruction identification, characterization, and/or location), and the like. Application of the signal processing technique with DAS for flow line surveillance provides a number of benefits including improving flow line lifespan and recovery by monitoring particulates, components that can create obstructions, and/or obstructions passing through the flow line, facilitating targeted remedial action for efficient flow obstruction management, reducing operational risk through the clear identification of flow obstructions, erosion, and/or failures in the flow line, and the like.

In addition, in some embodiments, use of the systems and methods described herein may provide knowledge of the presence, location, composition, etc. of components contributing to flow obstructions, and flow obstructions within a flow line, thereby allowing for improved remediation actions based on the processing results.

As disclosed herein, embodiments of the data processing techniques use a sequence of real time digital signal processing steps to isolate and extract the acoustic signal resulting from flow obstructions and/or fluids in the flow line from background noise, and allow real time detection of flow obstructions and/or fluids passing through the flow line using distributed fiber optic acoustic sensor data as the input data feed.

Referring now to FIG. 1, an example of a monitoring system 100 is shown according to some embodiments. Exemplary monitoring system 100 includes a flow line 114, an optical fiber 116, and an acquisition device 118. As will be described in more detail below, embodiments of monitoring assemblies comprising distributed acoustic sensor (DAS) system in accordance with the principles described herein can be positioned in monitoring system 100.

In general, a flow line 114 can be a pipe or hose that carries fluids between different locations as a production line in a facility. The flow line 114 can be metallic, or in some embodiments, plastic or polymeric, and the flow line 114 can be designed to handle the fluid types and pressures anticipated to pass through the flow line 114. In some embodiments, a flow line 114 can be a pipe that carries fluid (e.g., oil, gas, production water) between various sites on a production line. For example, the flow line 114 can connect a well head to a first piece of production equipment on the production line, and/or the flow line 114 can be a pipeline that carries fluids over long distances between a production facility and an end use or distribution location. Multiple other flow lines 114 may also be used to interconnect the various pieces of production equipment on the production line to enable fluid communication between the various pieces of production equipment. The flow line 114 may be in onshore or offshore well field and may be buried or at grade on the surface of land or the seafloor. The flow line 114 may be short in length or may run for multiple kilometers in onshore applications. While the flow line 114 has been described in the context of oil and gas field applications, it should be appreciated that the flow line 114 can be applied in a field that utilizes fluid communication pipes such as the flow line 114.

As shown in FIG. 1, the flow line 114 may include one or more bends 120 positioned such that when the fluid passes through the flow line 114, the fluid generally changes the direction of flow according to the bend 120. The bends 120 in FIG. 1 are shown as T shaped bends having approximately a 90 degree (°) angle. However, the bends 120 may otherwise be shaped as a curve or a radius bend configured to change the direction of flow of the fluid. While FIG. 1 only shows two bends 120 on the flow line 114, the flow line 114 may include any number of bends 120, including one bend or three or more bends. In some embodiments, the flow line 114 or a portion of interest thereof may not include any bends 120.

The fluid flowing into the flow line 114 may comprise more than one fluid component. Typical components include natural gas, hydrocarbon fluids (e.g., oil, etc.), water, steam, and/or carbon dioxide. The relative proportions of these components can vary over time based on conditions within a subsurface formation being drilled and a wellbore performing the drilling. Likewise, the composition of the fluid flowing into the flow line 114 sections throughout the length of the entire production string can vary significantly from section to section at any given time. In some embodiments when the flow line 114 is a pipeline, it may be expected that the fluid composition can be generally consistent, though components within the fluid (e.g., components such as waxes that can create flow blockages) may vary over time.

As fluid flows into the flow line 114, various particulates and components that can lead to flow blockages present in the subsurface formation can enter the flow line 114 along with a fluid (e.g., oil, water, natural gas, etc.). Such solid particles are referred to herein as "particulates," and can include any solids originating within the subterranean formation and/or precipitating out of the produced fluids during production regardless of size or composition. For example, the particulates may include any solid materials such as sand, rocks, crystals, hydrates, asphaltene, waxes, etc.

As will be further described below with reference to FIG. 3, the particulates that pass through flow line 114 (e.g., the bends 120 of the flow line 114) may cause substantial damage to the flow line 114 and/or result in the formation of flow blockages. As the particulates in the fluid reach the bend 120, the fluid can change flow direction while the particulates can be carried by momentum into the opposing wall of the flow line such that the particulates tend to hit the interior surface of the flow line 114 at the bend 120 before changing directions along the bend 120. Upon hitting the interior surface of the flow line 114 at the bend 120, the particulates may create acoustic sounds that can be detected using an acoustic sensor such as a DAS system. Similarly, the flow of the various fluids inside the flow line 114 can create acoustic sounds that can be detected using the acoustic sensor such as the DAS system. As flow blockages develop within the flow line 114, the acoustic signal generated by the fluid passing the flow blockage can change due to the fluid passing through a restriction formed by the flow blockage. When the flow blockage comprises a pig, the acoustic signals can comprise signals generated by the movement of the pig along the flow line 114 (e.g., based on contact between the pig and the flow line 114 wall). Each type of event such as the different fluid flows and fluid flow locations can produce an acoustic signature with unique frequency domain features.

As shown in FIG. 1, the flow line 114 can be coupled to the optical fiber 116 that receives the produced acoustic signal from the fluid flowing throw the flow line 114. The optical fiber 116 can serve as an optical path or channel along the length of the flow line 114 to allow detection of acoustic signals along the flow line 114. In some embodiments, the optical fiber 116 may be coupled to and disposed along an exterior of the flow line 114. In some embodiments, the optical fiber 116 can be wrapped around at least a portion 125 of the flow line 114. As shown in FIG. 1, the optical fiber 116 can be wrapped around the flow line 114 multiple times at portions 125, which is at the T shaped bends 120. In some embodiments, the optical fiber 116 can be coupled in a longitudinal direction along straight sections of the flow line 114 (e.g., such as along those sections of flow line 114 that do not include any bends 120). For longer flow lines 114, such as pipelines, the optical fiber 116 can be coupled to and disposed along the flow line 114 in a generally longitudinal direction. For pipelines with few or no bends, wrapping of the optical fiber 116 around the flow line 114 may not be necessary as a sufficient spatial separation along the flow line 114 may be achieved based on the length of the flow line 114.

In some embodiments, a length of the optical fiber 116 can be used to wrap around the portions 125 of the flow line 114, which may be based on a spatial resolution and diameter of the flow line 114. In order to differential locations along the flow line 114, a sufficient length of the optical fiber 116 may be used at one or more locations along the flow line 114 to distinguish the acoustic signals originating in one location from the acoustic signals originating in a nearby section. For example, a spatial resolution of the acoustic signals from the optical fiber 116 may be between 1 m and about 10 m, and an additional length of the optical fiber 116 can be used in one location to distinguish the acoustic signals from a location within a few meters of the location by using a length of the optical fiber 116 in that location that is greater than the spatial resolution obtained from the system. In some embodiments, a ratio of a length of the optical fiber 116 wrapped around the portion of the flow line 114 to an axial length of the flow line 114 can be at least 1.5:1, at least 2:1, at least 3:1, at least 4:1, at least 5:1, or at least 10:1. For example, for 6 inch flow lines with an outside diameter of 168.3 millimeters (mm) and an inside diameter of 116.1 mm, the length of optical fiber 116 wrapped around the portions 125 of the flow line 114 may be about 5 meters (m) to about 10 m.

For example, bends in the flow line 114 may be monitored with a higher spatial resolution in order to identify any erosion or blockages forming at the beds. The amount of fiber located at the bends 120 may depend on the spatial resolution of the signal created by the optical fiber 116 running along a portion of the flow line 114 and the ability of the DAS system to determine the location of the signal along the flow line 114. Some embodiments disclosed herein wrap the optical fiber 116 around the bends 120 of the flow line 114 for a predefined length that is sufficient to detect acoustic signals at a sufficient resolution to determine locations of the respective bend 120 of the flow line 114 at which particulates may be located and detect the acoustic signal of the particulates transporting through the flow line 114. In some embodiments, wrapping a predefined length of optical fiber 116 around portions 125 of the flow line 114 can provide the resolution of acoustic signals that may be used to identify particulates and/or flow blockages inside the flow line 114 and determine a level of wear, erosion, or blockage occurring at certain positions near the bends 120 of the flow line 114. In some embodiments, the optical fiber 116 can be tightly wound around the flow line 114 such that each coil of the wrapped optical fiber 116 is positioned tightly against one another.

The optical fiber 116 may be coupled to an exterior of the flow line 114 in various different manners. In some embodiments, the optical fiber 116 may directly attached to the exterior surface of the flow line 114. For example, the optical fiber 116 may be coupled or taped directly to the flow line 115. However, such a direct attachment of the optical fiber 116 to the flow line 114 may generate acoustic signals subject to by external noise sources.

In some embodiments, at least a portion of the optical fiber 116 may be positioned within a conduit 127 that is attached to the exterior surface of the flow line 114. The conduit 127 may surround and protect the optical fiber 116. The conduit 127 may be, for example, metallic (e.g., steel or copper) tubing, and the optical fiber 116 may be positioned inside of the conduit 127. In some embodiments, conduit 127 may have a diameter sufficiently small to secure the optical fiber 116 in place along the length of the flow line 114.

In some embodiments, the conduit 127 can be filled with a fluid, solid, or both, which may be a coupling material designed to transmit an acoustic signal from the conduit to the fiber such as an acoustic coupling gel 129. In some embodiments, the acoustic coupling material 129 may be a hydrogen scavenging gel or any other type of ultrasound gel used to provide acoustic continuity between the optical fiber and the flow line 114. An acoustic coupling material 129 such as a gel may enter the conduit 127 as a fluid, but over time, thicken into a gel material that secures the optical fiber 116 within the conduit 127 and provides continuity to detected acoustic signals. In some embodiments, the optical fiber 116 can be retained within the conduit 127 by the fluid, solid, or both acting as an acoustic coupling gel 129.

In an embodiment, the conduit 127 may not be used to protect the optical fiber 116 at the locations where the optical fiber 116 is wrapped or coiled around the flow line 114. In this case, the optical fiber 116, without the protection of the conduit 127, can be coiled around the flow line 114 at the bends 120. As shown by FIG. 1, the conduit 127 can be used to surround and protect the optical fiber 116 at the substantially straight portions of the flow line 114. In this case, the conduit 127 can run along the length of the substantially straight portions of the flow line 114 with the optical fiber 116 retained within the conduit 127. When the optical fiber 116 reaches the bend 120, the optical fiber 116 can pass out of the conduit 127 and wrap around the flow line 114 at the bends 120, and then re-enter the conduit 127 to attach along a length of a next substantially straight portion of the flow line 114.

Figure 2:
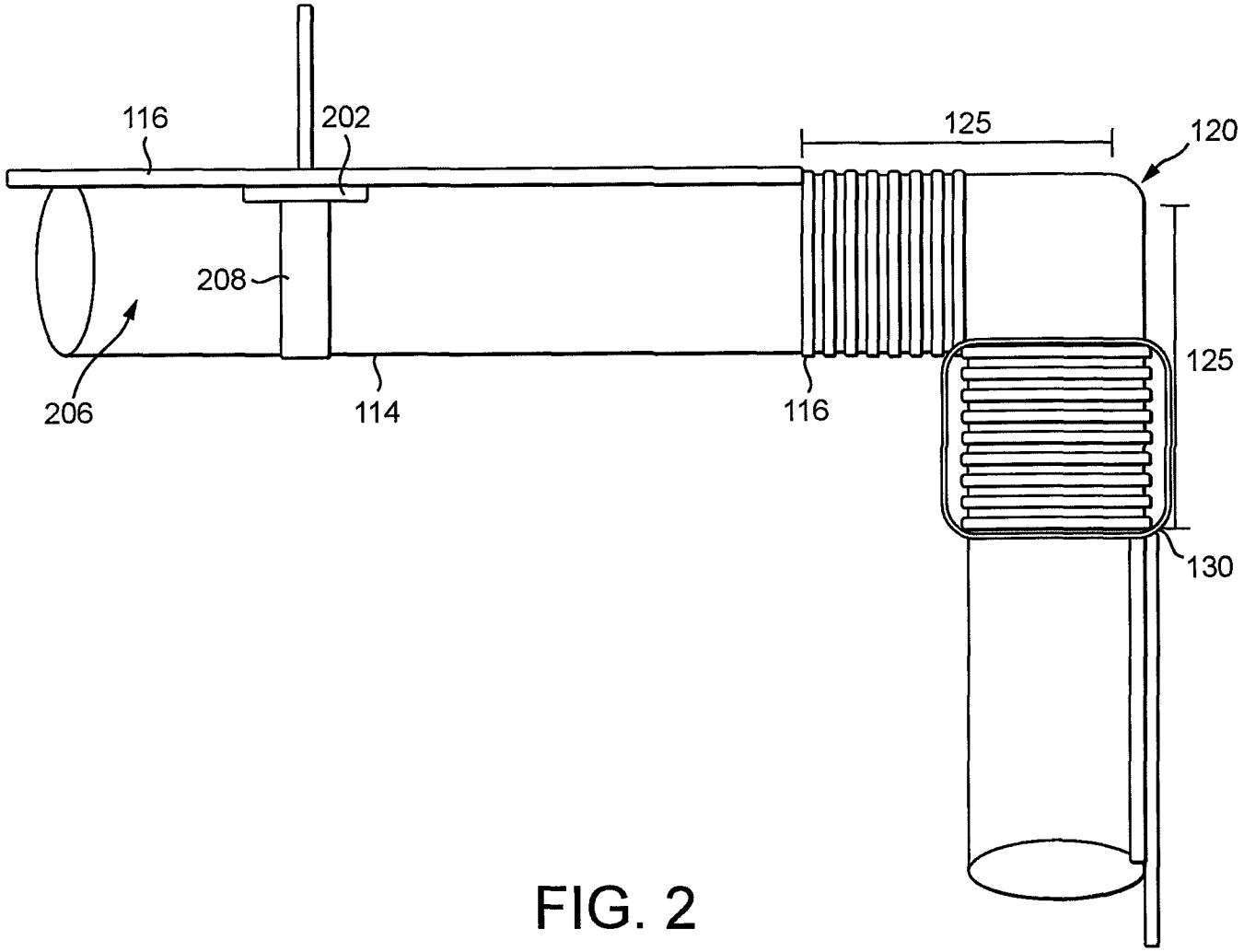
FIG. 2 is a schematic, cross-sectional illustration of a flow line with a compliance layer disposed between the flow line and the optical fiber according to an embodiment.

The conduit 127 may be directly attached to the exterior surface of the flow line 114 or a compliance layer may be disposed between the conduit 127 and a connection at one or more points along the flow line 114. Referring to FIG. 2, shown is a schematic illustration of a flow line 114 with a compliance layer 202 disposed between the optical fiber 116 and a connector 208 attached to the external surface 206 of the flow line 114. The connectors 208 may be used to support or otherwise position the flow line 114 within a facility. For example, the connector 208 can be a pipe hanger, support beam, or other structure. In some embodiments, the connector 208 can be used to couple the optical fiber 116 to the flow line 114, and a compliance layer can be disposed between the optical fiber 116 and the connector 208. External noises and/or vibrations can travel through the connectors 208, resulting in noise within the detected acoustic signal when the fiber is in contact with the connector 208. In order to avoid or reduce the noise transmitted to the optical fiber, the compliance layer 202 can be disposed between the optical fiber 116 and the connector 208. The compliance layer can be between an external surface 206 of the flow line 114 and the conduit or optical fiber at a connector 208.

In some embodiments, an external compliance layer 130 may also be used as an acoustic shielding that protects the optical fiber 116 from picking up external noise originating outside of the flow line 114 (thus, external compliance layer 130 may be referred to herein as "shielding 130"). For example, the shielding 130 can comprise a vibration isolation tape or foam that protects the optical fiber 116 from picking up noise created as a result of external factors, such as noise or vibration caused by external sources, such as pumps on a production line, wind and/or weather, and the like. In an embodiment, the compliance layer 202 can have a low acoustic impedance. In an embodiment, the compliance layer 202 serves to dampen a vibration in the flow line 114 from the optical fiber 116. As shown in FIG. 2, the external compliance layer 130 may be positioned around one or more, and in some embodiments, each coil of the optical fiber 116 wrapped around the portion 125 of the flow line 114.

As shown in FIG. 2, the compliance layer 202 can be positioned directly between the optical fiber 116 and the external surface 206 of the flow line 114 at or near one or more connectors 208. In an embodiment, the compliance layer 202 may be positioned between the conduit 127 carrying the optical fiber 116 and the external surface 206 of the flow line 114 (see e.g., FIG. 1). In some embodiments, the compliance layer 202 can be positioned between the optical fiber 116 and the flow line 114 at the portions 125 of the flow line 114 around which the optical fiber 116 is wrapped. In an embodiment, a single sheet of the compliance layer 202 may be wrapped around the portions 125 of the flow line 114, and the optical fiber 116 can be wrapped around the single sheet of the compliance layer 202, with or without the conduits 127.

Referring back to FIG. 1, a shielding 130 may be disposed about the optical fiber 116 on the exterior of the flow line 114. In some embodiments, the shielding 130 may be disposed on top of the conduits 127 along the substantially straight portions of the flow line 114, and/or the shielding 130 may be disposed on top of the optical fiber 116 wrapped around the flow line 114 at the bends 120. In some embodiments, the shielding 130 can be an acoustic shielding and/or an electromagnetic shielding protecting the optical fiber 116 from picking up external signals. For example, the shielding 130 can comprise a vibration isolation tape or foam that can absorb external noise and protect the optical fiber 116 from environmental factors. In some embodiments, the shielding 130 can comprise a structural layer to protect the optical fiber on the flow line 114.

The optical fiber 116 may be further secured to the flow line 114 using one or more attachment mechanisms such as clamps 131. In some embodiments, the clamp 131 may be a clasp, cable, tie, or the like that is configured to secure and fasten the optical fiber 116, or the conduit 127 carrying the optical fiber 116, to the flow line 114. In an embodiment, the clamp 131 may be a welding between the conduit 127 and the flow line 114 such that the conduit 127 is securely attached and welded to the flow line 114.

In order to retain the optical fiber 116 on the flow line 114, an adhesive can be used in some embodiments. The adhesive can be in the form of a layer or tape disposed between the optical fiber 116 and the flow line 114. The adhesive can help to retain the optical fiber 116 in contact with the flow line 114 between attachment mechanisms such as clamps 131, thereby providing acoustic coupling between the optical fiber 116 and the flow line 114 along the entire length of the flow line 114.

The various attachment mechanisms (e.g., clamps 131, shielding 130, any adhesives, etc.) may all be selected to acoustically couple the optical fiber 116 to the flow line 114 under conditions expected during operation. For example, the temperature rating of the various attachment mechanisms may be selected to operate at elevated temperatures that can be encountered with fluids in the flow line 114.

In some embodiments, slack can be introduced into the optical fiber 116 along the length of the flow line 114. The slack can help to avoid excessive strain on the fiber due to thermal cycling (e.g., thermal expansion and/or contraction) and/or movement of the flow line 114 during use. Slack can be introduced by providing additional optical fiber 116 length along the flow line 114, using for example, wrappings, undulations, or coils to provide additional length of optical fiber for expansion purposes. In some embodiments, an additional 0.1%-20%, alternatively 5%-15%, or alternatively 8%-12% length of optical fiber 116 can be provided along the length of the straight sections between successive bends in the pipe. While certain values are provided, the amount of slack can be less than 0.1% or greater than 20% depending on a number of factors such as the overall length of the flow line section, the orientation of the optical fiber 116 with respect to the flow line, and/or any slack built into adjacent portions of the optical fiber (e.g., at bends, etc.).

In some embodiments, the optical fiber 116 may be a single mode optical fiber 116. In some embodiments, the optical fiber 116 may include a multi-mode optical fiber 116. Whether single mode or multi-mode fiber is used, the optical fiber 116 can comprise one or more optical fibers. For example, when multiple fibers are present, one or more of the fiber optic cables may be used for acoustic sensing, and one or more of the fiber optic cables may be used for data transmissions. As another illustrative example of when multiple fibers are used, two or more of the fiber optic cables may be used for acoustic sensing, which may allow for at least one of the fiber optic cables to be used for error detection.

In some embodiments, a single continuous optical fiber 116 may be coupled to the entire flow line 114 of a production line to form a continuous optical path. One end of the single continuous optical fiber 116 can be coupled to the acquisition device 118, and the remainder of the single continuous optical fiber 116 can be disposed along the entire flow line 114. In some embodiments, the continuous optical fiber 116 may be wrapped around a subset of or all of the bends 120 of the entire flow line 114. In some embodiments, the optical fiber 116 is not wrapped around any portion of the flow line 114 (e.g., such as in embodiments in which flow line 114, or the portion of interest thereof, has no bends). In some embodiments, an optical fiber can be coupled to multiple flow lines. The intervening distance between different flow lines can be used to spatially segregate the signals received from different flow lines and different portions (e.g., bends, straight portions, etc.) of the individual flow lines. The length of the fiber can extend up to thousands of meters, and as a result, the optical fiber (whether in a single fiber or connected fibers) can be used with different flow lines that are spatially separated.

In some embodiments, the optical fiber 116 may be connected in sections along various sections of the flow line 114. In these embodiments, the optical fiber 116 can include multiple sections, each of which corresponds to a different location on the flow line 114. Each of the sections of the optical fiber 116 may be optically coupled together to form a single optical path between the coupled sections. The coupling can use connectors, splices, or any other suitable optical fiber connections. In this way, the sections of the optical fiber 116 may enable the locations of the particulates and/or flow blockages detected inside the flow line 114 to be easily mapped to a particular section of the optical fiber 116, while also allowing different sections to be replaced if needed.

In addition to the optical fiber 116, one or more additional, and optional, sensors 136 can also be used with the optical fiber 116 to provide additional data for processing purposes. As shown in FIG. 1, the sensor(s) 136 can be placed at or near a bend in the flow line 114. One or more sensors 136 can be present, and may be placed at a bend or along the straight portions of the flow line 114. The sensor(s) 136 can comprise any suitable sensors for monitoring flow lines including temperature sensors, vibration sensors, ultrasonic wall thickness sensors, point acoustic sensors, and the like. The data from the sensors(s) 136 can be used to provide additional inputs to the data processing system, verify the results, and/or providing data for developing the acoustic signatures, as described in more detail herein.

The optical fiber 116 allows sensing of vibrations along its length and can be coupled to the acquisition device 118 that is configured to capture and process the vibrations (e.g., vibrations corresponding to acoustic signals). The optical fiber 116 detects acoustic signals using an optical backscatter component of light injected into the optical fiber 116 for detecting acoustic perturbations (e.g., dynamic strain) along the length of the optical fiber 116. The light can be generated by a light generator or source 166 such as a laser, which can generate light pulses. The optical fiber 116 acts as the sensor element with no additional transducers in the optical path, and measurements can be taken along the length of the entire optical fiber 116. The measurements can then be detected by an optical receiver such as sensor 164 and selectively filtered to obtain measurements from a given point or range, thereby providing for a distributed measurement that has selective data for a plurality of zones along the optical fiber 116 at any given time. In this manner, the optical fiber 116 effectively functions as a distributed array of microphones spread over the entire length of the optical fiber 116.

The light reflected back up the optical fiber 116 as a result of the backscatter can travel back to the source 166, where the signal can be collected by a sensor 164 and processed (e.g., using a processor 168). In general, the time the light takes to return to the collection point is proportional to the distance traveled along the optical fiber 116. The resulting backscattered light arising along the length of the optical fiber 116 can be used to characterize the environment around the optical fiber 116 or to which the optical fiber 116 is connected. The use of a controlled light source 166 (e.g., having a controlled spectral width and frequency) may allow the backscatter to be collected and any disturbances along the length of the optical fiber 116 to be analyzed. In general, any acoustic or dynamic strain disturbances along the length of the optical fiber 116 can result in a change in the properties of the backscattered light, allowing for a distributed measurement of both the acoustic magnitude, frequency, and in some cases, of the relative phase of the disturbance.

The acquisition device 118 can be coupled to one end of the optical fiber 116. As discussed herein, the light source 166 can generate the light (e.g., one or more light pulses), and the sensor 164 can collect and analyze the backscattered light returning up the optical fiber 116. In some contexts, the acquisition device 118 including the light source 166 and the sensor 164 can be referred to as an interrogator. In addition to the light source 166 and the sensor 164, the acquisition device 118 generally comprises a processor 168 in signal communication with the sensor 164 to perform various analysis steps described in more detail herein. While shown as being within the acquisition device 118, the processor 168 can also be located outside of the acquisition device 118 including being located remotely from the acquisition device 118. The sensor 164 can be used to obtain data at various rates and may obtain data at a sufficient rate to detect the acoustic signals of interest with sufficient bandwidth. In some embodiments, resolution ranges of between about 1 meter and about 10 meters can be achieved based on the embodiments disclosed herein, though higher resolution systems having resolutions below 1 meter are also possible.

While the monitoring system 100 described herein can be used with a DAS system to acquire an acoustic signal for a location within the flow line 114, in general, any suitable acoustic signal acquisition system can be used with the processing steps disclosed herein. For example, various microphones or other sensors can be used to provide an acoustic signal at a given location based on the acoustic signal processing described herein. The benefit of the use of the DAS system is that an acoustic signal can be obtained across a plurality of locations and/or across a continuous length of the flow line 114 rather than at discrete locations.

Once processed by the interrogator, specific spectral signatures can be determined for each event by considering one or more frequency domain features. The resulting spectral signatures can then be used along with processed acoustic signal data to determine if an event (e.g., such as a flow obstruction event, previously described above) is occurring at a distance range of interest along the optical fiber, which can correspond to a particular section of the flow line 114. The spectral signatures can be determined by considering the different types of movement and flow occurring within a flow line and characterizing the frequency domain features for each type of movement.

Particulates in a fluid passing through a bend 120 can be considered first. As schematically illustrated in FIG. 3, particulates 302 within the fluid 306 can flow from a subsurface formation, into a well. At the surface, the fluid 306 containing the particulates 302 can flow into one or more flow lines 114. Once the particulates 302 and the fluid 306 enters the flow line 114, the fluid 306 flows through the bends 120 of the flow line 114, as shown by the arrows in FIG. 3. However, as the particulates 302 flow into the flow line 114 and reach a bend 120, the particulates 302 can collide against the inner surface 304 of the flow line 114, and with the optical fiber 116 itself in cases where the optical fiber 116 is disposed within the flow line 114, in a random fashion. Without being limited by this or any particular theory, the intensity of the collisions depends on the effective mass and the rate of change in the velocity of the impinging particulates 302. This can depend on a number of factors including, without limitation, the direction of travel of the particulates 302 within the flow line 114.

The resulting random impacts can produce a random, broadband acoustic signal that can be captured on the optical fiber 116, which can be coupled to the flow line 114. The random excitation response tends to have a broadband acoustic signal with excitation frequencies extending up to the high frequency bands, for example, up to and beyond about 5 kHz depending on the size of the particulates 302. In general, larger particle particulates 302 may produce higher frequencies. The intensity of the acoustic signal may be proportional to the concentration of particulates 302 generating the excitations such that a increased broad band power intensity can be expected at increasing particulates 302 concentrations. In some embodiments, the resulting broadband acoustic signals that can be identified can include frequencies in the range of about 5 Hz to about 10 kHz, frequencies in the range of about 5 Hz to about 5 kHz or about 50 Hz to about 5 kHz, or frequencies in the range of about 500 Hz to about 5 kHz. Any frequency ranges between the lower frequencies values (e.g., 5 Hz, 50 Hz, 500 Hz, etc.) and the upper frequency values (e.g., 10 kHz, 7 kHz, 5 kHz, etc.) can be used to define the frequency range for a broadband acoustic signal.

The particulates 302 within the flow line 114 can be carried within a carrier fluid 306, and the carrier fluid 306 can also generate high intensity acoustic background noise when flowing through the flow line 114 or passing a bend 120 of the flow line 114 due to the turbulence associated with the fluid flowing through the flow line 114. This background noise generated by the turbulent fluid flow is generally expected to be predominantly in a lower frequency region. For example, the fluid inflow acoustic signals can be between about 0 Hz and about 500 Hz, or alternatively between about 0 Hz and about 200 Hz. Increased power intensity can be expected at low frequencies resulting from increased turbulence in the carrier fluid flow. The background noises can be detected as superimposed signals on the broad-band acoustic signals produced by the particulates 302 when the particulates 302 enter the flow line 114 or pass a bend 120 of the flow line 114.

A number of acoustic signal sources can also be considered along with the types of acoustic signals these sources generate. In general, a variety of signal sources can be considered including fluid 306 flow with or without particulates 302 within or through the flow line 114, fluid 306 with or without particulates 302 passing through a bend 120 of the flow line 114, gas/liquid inflow, mechanical instrumentation, and potential point reflection noise within the optical fiber 116 caused by cracks in the optical fiber 116 used.

In some embodiments, various spectral features may be analyzed (e.g., by the interrogator as previously described above) so as to detect (e.g., identify, classify, locate, track, etc.) a flow obstruction event as previously described above. For instance, referring now to FIGS. 4 and 5, in some embodiments, one or more obstructions 310, 312 may be disposed within the flow line 114. As previously described above, the obstructions 310, 312 may comprise a piece of equipment, particulates, hydrates, waxes, asphaltene, or some combination thereof. More specifically, the obstruction 310 in FIG. 4 comprises a collection of hydrates, waxes, asphaltene, sand, etc. that are blocking (at least partially) the flow of fluid 306 through flow line 114, and the obstruction 312 in FIG. 5 comprises a flow line pig (or other flowable equipment or component) that is blocking (again, at least partially) the flow of fluid 306 through flow line 114.

Regardless of the type for form of the obstruction (e.g., obstructions 310, 312), when the fluid 306 (which may include particulates 302 as previously described above) encounters and thus impacts and/or flows around the obstructions 310, 312, vibrations are generated that propagate throughout the fluid. The produced vibration can produce a broadband acoustic signal that can be captured on the optical fiber 116, which can be coupled to and/or disposed within the flow line 114 as previously described above (see e.g., FIG. 3).

Figure 4:
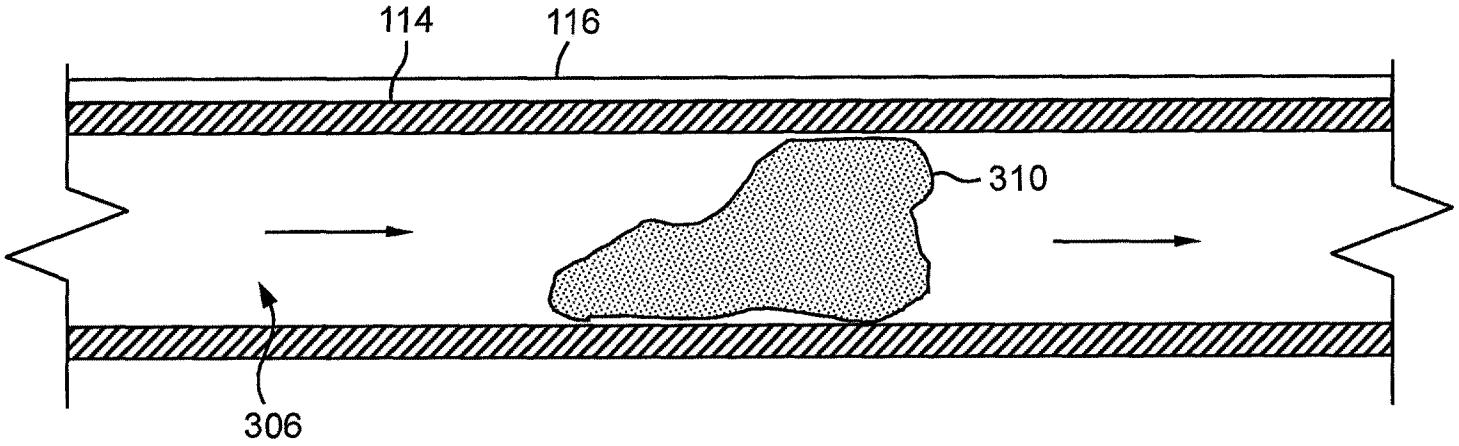
FIG. 4 is a schematic, cross-sectional illustration of a flow line having an optical fiber coupled thereto and a flow obstruction disposed therein that comprises a deposit of particulates according to an embodiment.
Figure 5:
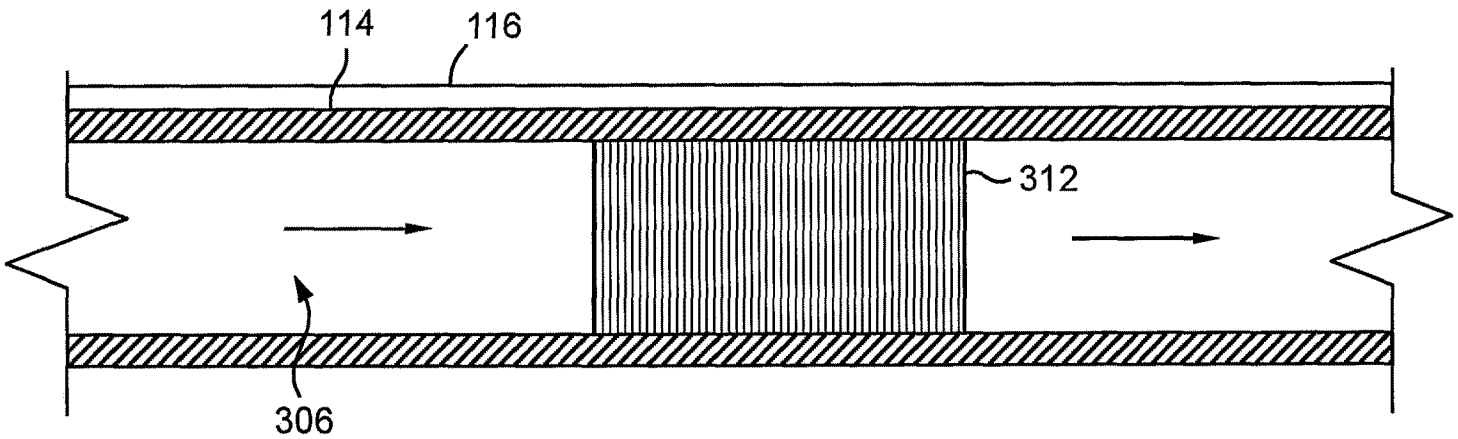
FIG. 5 is a schematic, cross-sectional illustration of a flow line having an optical fiber coupled thereto and a flow obstruction disposed therein that comprises a flow line pig according to an embodiment.

Regardless of whether the optical fiber 116 is receiving an excitation from a hydrate, particular, wax, and/or other obstruction, such as obstruction 310 in FIG. 4 or an equipment obstruction, such as pig 312 in FIG. 5, the broadband acoustic signal received by the fiber 116 may be utilized in the manner described herein to determine the location, size, and/or composition of the obstruction within the flow line 114. Thus, personnel may utilize these determinations in order to track the location and/or progression of the obstruction within the flow line 114 (e.g., such as in the case of tracking the progress of a pig through the flow line 114) and/or perform an appropriate mitigation response (e.g., as in the case of removing or otherwise mitigating a hydrate, wax, particular, etc. obstruction within the flow line 114).

For acoustic signals generated by mechanical instrumentation, the sounds can be detected by the optical fiber 116 in some instances depending on the distance between the sound generation and the portion of the optical fiber 116 being used to detect the sounds and/or the use and type of material for a compliance layer, if present. Various mechanical noises would be expected to have low frequency sounds. For example, various motors can operate in the 50 Hz to 60 Hz range, and it is expected that the resulting acoustic signal would have a spectral energy in a narrow band. As a result, it is expected that the sounds from the mechanical instrumentation and geophysical sources can be filtered out based on various filtering techniques (e.g., a low-pass frequency filter, etc.).

For point reflection type noises, these are usually broadband in nature but can occur at spatially confined location and usually do not span the expected spatial resolution of the acquisition device 118. These may be removed as part of the pre-processing steps by spatial averaging or median filtering the data.

Based on the expected sound characteristics from the potential acoustic signal sources, the acoustic signature of each event (e.g., such as a flow obstruction event) can be defined relative to background noise contributions. For fluid 306 encountering a flow obstruction 310, 312 within flow line 114, the acoustic signature can be seen as the presence of a distinct broadband response along with the presence of high frequency components in the resulting response. The uniqueness in the signature of the fluid 306 encountering the flow obstruction 310, 312 enables application of selective signal isolation routines to extract the relevant information pertaining to acoustics describing fluid 306 impacting and/or flowing around the flow obstruction 310, 312 as described herein. Further, the characteristics of the portion of the acoustic signal resulting from the fluid 306 encountering the flow obstruction 310, 312 within the flow line 114 can allow for the location and potentially the composition and/or size of the obstruction (e.g., obstruction 310) to be determined. The acoustic signatures of the other events can also be determined and used with the processing to enable identification of each event.

Referring again to FIG. 1, the processor 168 within the acquisition device 118 can be configured to perform various data processing steps to detect the presence of one or more events along the length of the flow line 114. The acquisition device 118 can comprise a memory 170 configured to store an application or program to perform the data analysis. While shown as being contained within the acquisition device 118, the memory 170 can comprise one or more memories, any of which can be external to the acquisition device 118. In an embodiment, the processor 168 can execute the program, which can configure the processor 168 to filter the acoustic data set spatially, determine one or more frequency domain features of the acoustic signal, compare the resulting frequency domain feature values to the acoustic signatures, and determine whether or not an event is occurring at the selected location based on the analysis and comparison. The analysis can be repeated across various locations along the length of the flow line 114 to determine the occurrence of one or more events (e.g., flow obstruction events) and/or event locations (e.g., flow obstruction event locations) along the length of the flow line 114.

When the acoustic sensor comprises a DAS system, the optical fiber 116 can return raw optical data in real time or near real time to the acquisition unit 118. In some embodiments, the raw data can be stored in the memory 170 for various subsequent uses. The sensor 164 can be configured to convert the raw optical data into an acoustic data set. Depending on the type of DAS system employed, the optical data may or may not be phase coherent and may be preprocessed to improve the signal quality (e.g., for optoelectronic noise normalization/de-trending single point-reflection noise removal through the use of median filtering techniques or even through the use of spatial moving average computations with averaging windows set to the spatial resolution of the acquisition unit, etc.).

Figure 6:
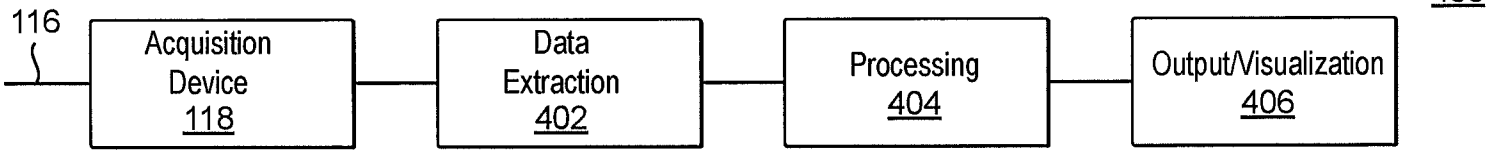
FIG. 6 illustrates an embodiment of a schematic processing flow for an acoustic signal.

As shown schematically in FIG. 6, an embodiment of a system 400 for detecting a flow obstruction event within the flow line 114 is shown. The system 400 can comprise the acquisition device 118, data extraction unit 402, a processing unit 404, and/or an output or visualization unit 406. The data extraction unit 402 can obtain the optical data and perform the initial pre-processing steps to obtain the initial acoustic information from the signal returned from the flow line 114. Various analyses can be performed including frequency band extraction, frequency analysis and/or transformation, intensity and/or energy calculations, and/or determination of one or more properties of the acoustic data. Following the data extraction unit 402, the resulting signals can be sent to a processing unit 404. Within the processing unit 404, the acoustic data can be analyzed, for example, by being compared to one or more acoustic signatures to determine if an event of interest is present (e.g., such as a flow obstruction event as previously described above), and/or used with one or more models (e.g., one or more machine learning models, multivariate models, etc.). In some embodiments, the acoustic signatures can define thresholds or ranges of frequencies and/or frequency domain features. The analysis can then include comparing one or more thresholds or references to determine if a specific signal is present. When the frequency domain features match (or sufficiently correspond to) the acoustic signature of a flow obstruction (e.g., flow obstruction 310 and/or 312 in FIGS. 4 and 5 as previously described) within the flow line 114, the processing unit 404 can detect the flow obstruction within the flow line 114 using the acoustic signal received from the optical fiber 116. In some embodiments, one or more of the frequency domain features can be used with one or more models to determine if the flow obstruction event has occurred within the flow line. In some embodiments, the size, location, composition, and/or other characteristics of the flow obstruction 310, 312 may be determined as a result of the acoustic signal received from the optical fiber 116 during operations.

When acoustics signatures are used, the acoustic signatures can be determined using a testing and calibration process. A model flow line, which may be similar to the flow line 114 shown in FIG. 2, may be used to perform the testing process. An optical fiber (e.g., optical fiber 116) may be coupled to an exterior surface of the model flow line using the same or a similar configuration as will be used to measure acoustic signals from the flow lines during use.

Figure 3:
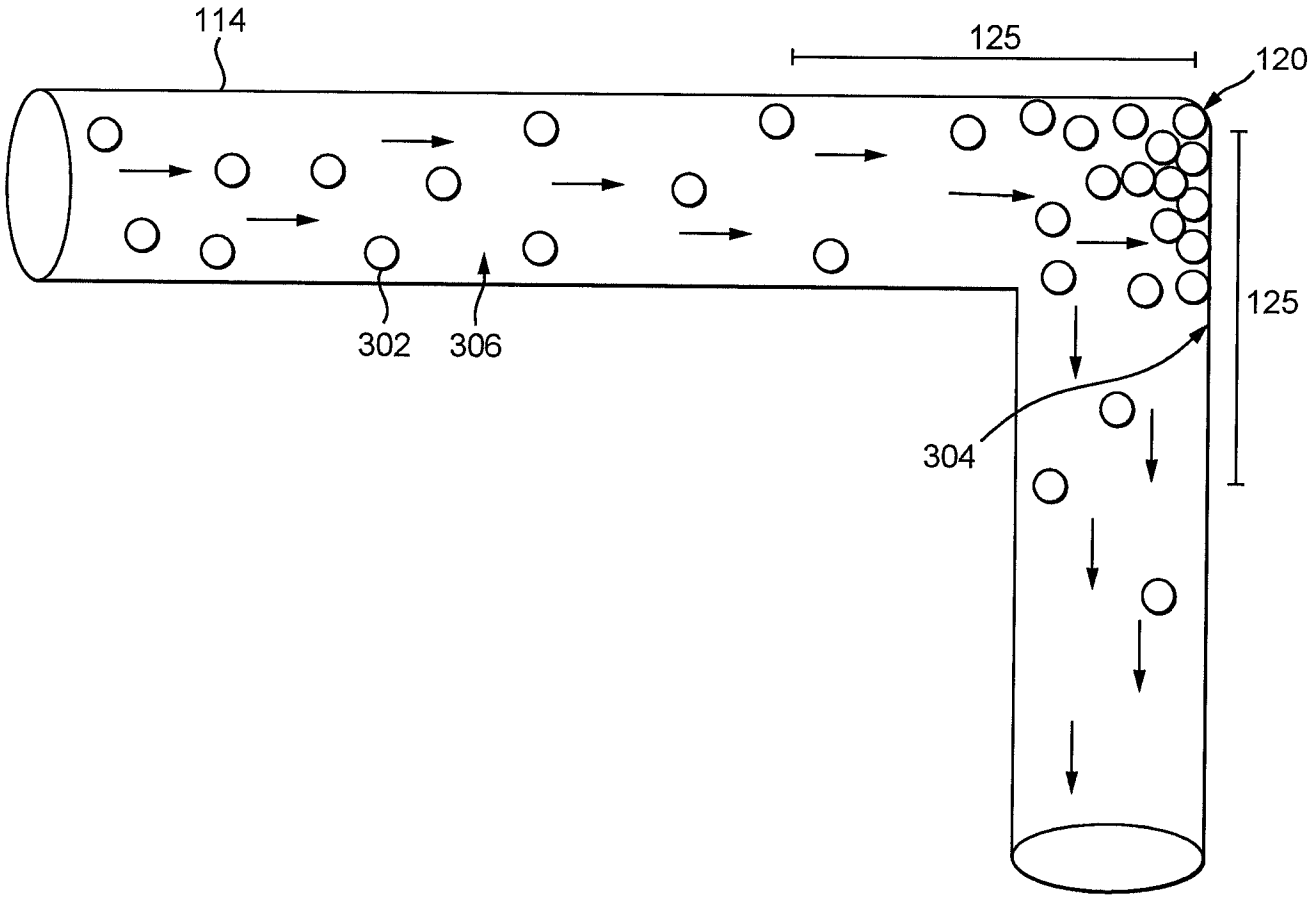
FIG. 3 a schematic, cross-sectional view of an embodiment of a flow line with particulates passing through a bend of the flow line.

During testing, one or more fluids, such as fluid 306 in FIG. 3, (e.g., having different compositions and/or flow regimes) may be passed through the model flow line, in which no flow obstructions are present, for a predetermined period of time. As the fluid(s) travel through the model flow line, acoustic signals can be obtained from the optical fiber and computations can be performed to determine the frequency domain features associated with different events caused by the fluid when flow. Subsequently, one or more fluids 306 may be passed through the model flow line 114 for a predetermined period of time; however, one or more flow obstructions (e.g., flow obstructions 310, 312) may be flowed or placed within the flow line 114 during this subsequent testing procedure. During this process, acoustic signals can be obtained from the optical fiber and computations can be performed to determine the frequency domain features associated with various flow obstruction events caused by the fluids 306 encountering the flow obstructions. In some embodiments, flow obstructions (e.g., flow obstruction 310) of different sizes, compositions, etc. may be placed or flowed through the model flow line 114, so that frequency domain features associated with these differently configured flow obstructions (e.g., flow obstructions 310) caused by the fluids 306 encountering the flow obstructions may be determined. The resulting data can comprise the acoustic signals correlated with known flow obstruction events, which can be referred to as a labeled data set that can be used to determine the acoustic signatures and/or one or more models to determine the presence or absence of a flow obstruction event.

An analysis of the different frequency domain features associated with fluid flow within the model flow line both with and without flow obstructions disposed or flowed therein may be used to determine the acoustic signatures that are used to determine if a specific signal is present. For example, the thresholds or references that are used to determine if a specific signal is present are based on a comparison of the different acoustic signatures associated with the model flow line fluid flow both with and without flow obstructions. Various methods can be used to develop the acoustic signatures such as various supervised learning techniques. In some embodiments, various flow obstruction event signatures (comprising various thresholds or ranges, etc. of frequency domain features) may be constructed that identify, locate, and/or characterize (e.g., size, composition, etc.) a flow obstruction within a flow line during operations based on acoustic data (e.g., such as the data obtained from the model flow line 114 during flow with and without obstructions).

In some embodiments, the acoustic signatures can be determined during use by using data from one or more sensors (e.g., sensor(s) 136 in FIG. 1). The sensors can provide data on the flow regimes, the presence of sand in the flow line 114, sand impingement, the presence, location, and/or characterization of flow obstructions, and the like. The acoustic signatures can be determined by obtaining actual data and using the data from the sensor(s) to develop the signature. In an embodiment, the acoustic data can be obtained during use, for example, using the fiber coupled to the flow line 114.

During use, the acoustic signal produced by the production fluid can be monitored. The sensor(s) can be used to identify the fluid composition and/or flow regime. Over time, fluid with and without flow obstructions 310, 312 can be expected within the flow line. By identifying the different fluid compositions and/or flow regimes with the additional sensor(s), the corresponding acoustic signals can be obtained from the optical fiber 116 and computations can be performed to determine the frequency domain features associated with different events caused by the fluid 306 with and without flow obstructions 310, 312. An analysis of the different frequency domain features may be used to determine the acoustic signatures that are used to determine if a specific signal is present. For example, the thresholds or references that are used to determine if a specific signal is present are based on a comparison of the different acoustic signatures. As noted above, various models can be used to develop the acoustic signatures from the data, using one or more of the frequency domain features or any combinations thereof.

The processing unit 404 can use the determination of one or more frequency domain features from the acoustic signal to determine the presence of one or more events (e.g., a flow obstruction event) at one or more locations on a flow line 114 based on the presence of the frequency domain features matching one or more acoustic signatures. In some embodiments, the processing unit 404 can also use the determination to determine the size, composition, etc. of a flow obstruction 310, 312 based on the presence of an acoustic signal matching one or more acoustic signatures associated with flow obstructions of a certain size, composition, etc.

During use, the additional sensor(s) can optionally be used to verify or validate the results from the processing of the acoustic signals from the optical fiber 116. When the presence of a flow obstruction 310, 312 is detected, the results can be compared to the data from other sensors in the system to verify the presence of the flow obstruction event such as flow or pressure sensors to detect an increased pressure drop across a flow obstruction. The verified data can then be used in the remaining process.

Whether a test system or in-situ sensors are used to obtain data on the flow characteristics, composition, and/or impingement of particles in the flow line (collectively referred to as "reference data"), one or more models can be developed for the events using the reference data. The model(s) can be developed by determining one or more frequency domain features from the acoustic signal for at least a portion of the reference data. The training of the model(s) can use machine learning, including any supervised or unsupervised learning approach. For example, one or more of the model(s) can be a neural network, a Bayesian network, a decision tree, a logistical regression model, a normalized logistical regression model, k-means clustering, or the like.

In some embodiments, the model(s) can be developed and trained using a logistic regression model. As an example for training of a model used to determine the presence or absence of a flow obstruction within the flow line 114, the training of the model can begin with providing the one or more frequency domain features to the logistic regression model corresponding to one or more reference data sets in which flow obstructions are present. Additional reference data sets can be provided in which flow obstructions are not present. For example, a labeled data set obtained during testing can be used to provide the one or more frequency domain features correlated with the presence and absence of one or more flow blockage events. The one or more frequency domain features can be provided to the logistic regression model, and a first multivariate model can be determined using the one or more frequency domain features as inputs. The first multivariate model can define a relationship between a presence and an absence of the flow obstruction in the flow line 114, and/or a presence or absence of a flow obstruction of a particular size, shape, composition, etc.

The one or more frequency domain features can comprise any frequency domain features as well as combinations and transformations thereof. For example, in some embodiments, the one or more frequency domain features comprise a spectral centroid, a spectral spread, a spectral roll-off, a spectral skewness, an RMS band energy, a total RMS energy, a spectral flatness, a spectral slope, a spectral kurtosis, a spectral flux, a spectral autocorrelation function, combinations and/or transformations thereof, or any normalized variant thereof. In some embodiments, the one or more frequency domain features comprise a normalized variant of the spectral spread (NVSS) and/or a normalized variant of the spectral centroid (NVSC).

In the model, the multivariate model equations can use the frequency domain features or combinations or transformations thereof to determine when a specific condition is present such as the presence of flow obstruction(s), etc. The multivariate model can define a threshold, decision point, and/or decision boundary having any type of shapes such as a point, line, surface, or envelope between the presence and absence of the specific condition. In some embodiments, the multivariate model can be in the form of a polynomial, though other representations are also possible. When models such a neural networks are used, the thresholds can be based on node thresholds within the model. As noted herein, the multivariate model is not limited to two dimensions (e.g., two frequency domain features or two variables representing transformed values from two or more frequency domain features), and rather can have any number of variables or dimensions in defining the threshold between the presence or absence of the condition. When used, the detected values can be used in the multivariate model, and the calculated value can be compared to the model values. The presence of the condition can be indicated when the calculated value is on one side of the threshold and the absence of the condition can be indicated when the calculated value is on the other side of the threshold. Thus, each multivariate model can, in some embodiments, represent a specific determination between the presence or absence of a corresponding condition. Different multivariate models, and therefore thresholds, can be used for each condition, and each multivariate model can rely on different frequency domain features or combinations or transformations of frequency domain features. Since the multivariate models define thresholds for the determination and/or identification of specific conditions, the multivariate models and fluid flow model using such multivariate models can be considered to be event signatures for each type of fluid flow, flow obstruction type, composition, location, and/or size, and the like.

Once the model(s) are trained or developed, the model(s) can be verified or validated. In some embodiments, the plurality of the reference data sets used for training the model(s) can be a subset of the plurality of reference data sets, and the tests used to validate the models can be another subset of the reference data sets. A method of developing model(s) according to this disclosure can further include the validation of the trained fluid flow model using the reference data from one or more tests. Additional data obtained from the additional sensors can also be used during operation to continue to validate the model(s) over time.

The validation process can include providing a portion of the reference data to each of the model(s). A presence or absence of at least one condition can be determined based on an output of each of the model(s). Should the accuracy of the model(s) be sufficient (e.g., meeting a confidence threshold), then the model(s) can be used to detect and/or identify conditions within the flow lines. If the accuracy is not sufficient, then additional data and training or development can be carried out to either find new frequency domain feature relationships to define the multivariate model(s) or improve the derived multivariate model(s) to more accurately predict the presence and identification of the conditions. In this process, the development, validation, and accuracy checking can be iteratively carried out until a suitable model or suitable models are determined. Using the validation process, a confidence level can be determined based on the validating. Remediation or workover procedures can be performed based on the confidence level in some embodiments.

The resulting analysis information can then be sent from the processing unit 404 to the output/visualization unit 406 where various information such a visualization of the location of the one or more events and/or information providing quantification information (e.g., an amount of particulates 302 passing through the bend 120, an amount of wear of the flow line 114 at the bend 120, and the like) can be visualized in a number of ways. In some embodiments, the resulting event information can be visualized on a piping schematic, process flow diagram, on a time log, or any other number of displays to aid in understanding where the event is occurring, and in some embodiments, to display a location, progression, type, composition, and/or size of a flow obstruction within the flow line 114. While illustrated in FIG. 6 as separate units, any two or more of the units shown in FIG. 6 can be incorporated into a single unit. For example, a single unit can be used to provide analysis, output, and optionally, visualization of the resulting information.

A number of specific processing steps can be performed to determine the presence of an event such as a flow obstruction event. In some embodiments, the noise detrended "acoustic variant" data can be subjected to an optional spatial filtering step following the pre-processing steps, if present. This is an optional step and helps focus primarily on an area or location of the flow line 114. For example, the spatial filtering step can be used to focus on one or more locations within or along flow line 114 where there is heightened or maximum likelihood of flow obstruction(s) (which may be a function of operating conditions, fluid flow composition, etc.) when such an event is being examined. In an embodiment, the spatial filtering can narrow the focus of the analysis to one or more portions 125 of the flow line 114, thereby simplifying the data analysis operations. The resulting data set produced through the conversion of the raw optical data can be referred to as the acoustic sample data.

This type of filtering can provide several advantages. Whether or not the acoustic data set is spatially filtered, the resulting data, for example the acoustic sample data, used for the next step of the analysis can be indicative of an acoustic sample over a defined length (e.g., the entire length of the optical fiber, some portion thereof, or a particular point along the flow line 114). In some embodiments, the acoustic data set can comprise a plurality of acoustic samples resulting from the spatial filter to provide data over a number of different areas and/or sample periods. In some embodiments, the acoustic sample data contains information over the entire frequency range at the area or location represented by the sample. This is to say that the various filtering steps, including the spatial filtering, do not remove the frequency information from the acoustic sample data.

The processor 168 (see e.g., FIG. 1) can be further configured to acoustic sample data into the frequency domain to allow for the determination of the plurality of frequency domain features, as described in more detail herein. For example, the processor 168 can perform Discrete Fourier transformations (DFT) or a short time Fourier transform (STFT) of the acoustic variant time domain data measured at each section along optical fiber 116 or a section thereof to spectrally check the conformance of the acoustic sample data to one or more acoustic signatures. The spectral conformance check can be used to determine if the expected signature of an event is present in the acoustic sample data. Spectral feature extraction through time and space can be used to determine the spectral conformance and determine if an acoustic signature (e.g., a signature or signatures of a flow obstruction event) is present in the acoustic sample. Within this process, various frequency domain features can be calculated for the acoustic sample data.

The use of the frequency domain features to identify one or more events has a number of advantages. First, the use of the frequency domain features results in significant data reduction relative to the raw DAS data stream. Thus, a number of frequency domain features can be calculated to allow for event identification while the remaining data can be discarded or otherwise stored. The remaining analysis can performed using the frequency domain features. Even when the raw DAS data is stored, the remaining processing power is significantly reduced through the use of the frequency domain features rather than the raw acoustic data itself. Further, the use of the frequency domain features provides a concise, quantitative measure of the spectral character or acoustic signature of specific sounds pertinent to flow line 114 surveillance and other applications that may directly be used for real-time, application-specific signal processing.

While a number of frequency domain features can be determined for the acoustic sample data, not every frequency domain feature may be used in the characterization of each acoustic signature. The frequency domain features represent specific properties or characteristics of the acoustic signals. There are a number of factors that can affect the frequency domain feature selection for each event. For example, a chosen descriptor should remain relatively unaffected by the interfering influences from the environment such as interfering noise from the electronics/optics, concurrent acoustic sounds, distortions in the transmission channel, and the like. In general, electronic/instrumentation noise is present in the acoustic signals captured on the DAS or any other electronic gauge, and it is usually an unwanted component that interferes with the signal.

As a further consideration in selecting the frequency domain feature(s) for an event, the dimensionality of the frequency domain feature should be compact. A compact representation is desired to decrease the computational complexity of subsequent calculations. The frequency domain feature should also have discriminant power. For example, for different types of audio signals, the selected set of descriptors should provide altogether different values. A measure for the discriminant power of a feature is the variance of the resulting feature vectors for a set of relevant input signals. Given different classes of similar signals, a discriminatory descriptor should have low variance inside each class and high variance over different classes. The frequency domain feature should also be able to completely cover the range of values of the property it describes. As an example, the chosen set of frequency domain features should be able to completely and uniquely identify the signatures of each of the acoustic signals pertaining to a selected flow line 114 event as described herein (e.g., such as a flow obstruction event). Such frequency domain features can include, but are not limited to, the spectral centroid, the spectral spread, the spectral roll-off, the spectral skewness, the root mean square (RMS) band energy (or the normalized sub-band energies/band energy ratios), a loudness or total RMS energy, a spectral flux, and a spectral autocorrelation function.

As an example, the spectral centroid denotes the "brightness" of the sound captured by the optical fiber 116 and indicates the center of gravity of the frequency spectrum in the acoustic sample. The spectral centroid can be calculated as the weighted mean of the frequencies present in the signal, where the magnitudes of the frequencies present can be used as their weights in some embodiments. The computed spectral centroid may be scaled to value between 0 and 1. Higher spectral centroids typically indicate the presence of higher frequency acoustics and help provide an immediate indication of the presence of high frequency noise. The calculated spectral centroid can be compared to a spectral centroid threshold or range for a given event, and when the spectral centroid meets or exceeds the threshold, the event of interest may be present.

The absolute magnitudes of the computed spectral centroids can be scaled to read a value between zero and one (e.g., normalized, etc.). The turbulent noise generated by other sources such as fluid 306 flow and inflow may typically be in the lower frequencies (e.g., under about 100 Hz) and the centroid computation can produce lower values, for example, around or under 0.1 post rescaling. The introduction of particulates 302 can trigger broader frequencies of sounds (e.g., a broad band response) that can extend in spectral content to higher frequencies (e.g., up to and beyond 5,000 Hz).

As another example of a frequency domain feature, the spectral spread can also be determined for the acoustic sample. The spectral spread is a measure of the shape of the spectrum and helps measure how the spectrum is distributed around the spectral centroid. Lower values of the spectral spread correspond to signals whose spectra are tightly concentrated around the spectral centroid. Higher values represent a wider spread of the spectral magnitudes and provide an indication of the presence of a broad band spectral response. The calculated spectral spread can be compared to a spectral spread threshold or range, and when the spectral spread meets exceeds the threshold or falls within the range, the event of interest may be present.

The spectral roll-off is a measure of the bandwidth of the audio signal. The Spectral roll-off of the $i^{th}$ frame, is defined as the frequency bin 'y' below which the accumulated magnitudes of the short-time Fourier transform reach a certain percentage value (usually between 85%-95%) of the overall sum of magnitudes of the spectrum.

$$\sum_{k=1}^{y} |X_i(k)| = \frac{c}{100} \sum_{k=1}^{N} |X_i(k)| \quad \text{(Eq. 3)}$$

Where c=85 or 95. The result of the spectral roll-off calculation is a bin index and enables distinguishing acoustic events based on dominant energy contributions in the frequency domain.

The spectral skewness measures the symmetry of the distribution of the spectral magnitude values around their arithmetic mean.

The RMS band energy provides a measure of the signal energy within defined frequency bins that may then be used for signal amplitude population. The selection of the bandwidths can be based on the characteristics of the captured acoustic signal. In some embodiments, a sub-band energy ratio representing the ratio of the upper frequency in the selected band to the lower frequency in the selected band can range between about 1.5:1 to about 3:1. In some embodiments, the sub-band energy ratio can range from about 2.5:1 to about 1.8:1, or alternatively be about 2:1. In some embodiments, the RMS band energies may also be expressed as a ratiometric measure by computing the ratio of the RMS signal energy within the defined frequency bins relative to the total RMS energy across the acquisition (Nyquist) bandwidth. This may help to reduce or remove the dependencies on the noise and any momentary variations in the broadband sound.

The total RMS energy of the acoustic waveform calculated in the time domain can indicate the loudness of the acoustic signal. In some embodiments, the total RMS energy can also be extracted from the temporal domain after filing the signal for noise.

The spectral flatness is a measure of the noisiness/tonality of an acoustic spectrum. It can be computed by the ratio of the geometric mean to the arithmetic mean of the energy spectrum value and may be used as an alternative approach to detect broadbanded signals (e.g., such as those caused by sand ingress). For tonal signals, the spectral flatness can be close to 0 and for broader band signals it can be closer to 1.

The spectral slope provides a basic approximation of the spectrum shape by a linearly regressed line. The spectral slope represents the decrease of the spectral amplitudes from low to high frequencies (e.g., a spectral tilt). The slope, the y-intersection, and the max and media regression error may be used as features.

The spectral kurtosis provides a measure of the flatness of a distribution around the mean value.

The spectral flux is a measure of instantaneous changes in the magnitude of a spectrum. It provides a measure of the frame-to-frame squared difference of the spectral magnitude vector summed across all frequencies or a selected portion of the spectrum. Signals with slowly varying (or nearly constant) spectral properties (e.g.: noise) have a low spectral flux, while signals with abrupt spectral changes have a high spectral flux. The spectral flux can allow for a direct measure of the local spectral rate of change and consequently serves as an event detection scheme that could be used to pick up the onset of acoustic events that may then be further analyzed using the feature set above to identify and uniquely classify the acoustic signal.

The spectral autocorrelation function provides a method in which the signal is shifted, and for each signal shift (lag) the correlation or the resemblance of the shifted signal with the original one is computed. This enables computation of the fundamental period by choosing the lag, for which the signal best resembles itself, for example, where the autocorrelation is maximized. This can be useful in exploratory signature analysis/even for anomaly detection for well integrity monitoring across specific depths where well barrier elements to be monitored are positioned.

Any of these frequency domain features, or any combination of these frequency domain features, can be used to provide an acoustic signature for a flow line 114 event (e.g., a flow obstruction event). In some embodiments, a selected set of characteristics can be used to provide the acoustic signature for each event, and/or all of the frequency domain features that are calculated can be used as a group in characterizing the acoustic signature for an event. The specific values for the frequency domain features that are calculated can vary depending on the specific attributes of the acoustic signal acquisition system, such that the absolute value of each frequency domain feature can change between systems. In some embodiments, the frequency domain features can be calculated for each event based on the system being used to capture the acoustic signal and/or the differences between systems can be taken into account in determining the frequency domain feature values for each signature between the systems used to determine the values and the systems used to capture the acoustic signal being evaluated.

A plurality of frequency domain features can be used to characterize different types of events occurring at a flow line 114, such as flow obstruction events, which may include flow obstructions of different types, sizes, compositions, etc. In some embodiments, different events can produce unique acoustic signals, which can be characterized using a plurality of frequency domain features.

While exemplary numerical ranges are provided herein, the actual numerical results may vary depending on the data acquisition system and/or the values can be normalized or otherwise processed to provide different results. As a result, the signatures for each event may have different thresholds or ranges of values for each of a plurality of frequency domain features.

In order to obtain the frequency domain features, the acoustic sample data can be converted to the frequency domain. In an embodiment, the raw optical data may contain or represent acoustic data in the time domain. A frequency domain representation of the data can be obtained using a Fourier Transform. Various algorithms can be used as known in the art. In some embodiments, a Short Time Fourier Transform technique or a Discrete Time Fourier transform can be used. The resulting data sample may then be represented by a range of frequencies relative to their power levels at which they are present. The raw optical data can be transformed into the frequency domain prior to or after the application of the spatial filter. In general, the acoustic sample will be in the frequency domain in order to determine the plurality of frequency domain features (e.g., the spectral centroid, the spectral spread, etc.). The processor 168 can be configured to perform the conversion of the raw acoustic data and/or the acoustic sample data from the time domain into the frequency domain. In the process of converting the signal to the frequency domain, the power across all frequencies within the acoustic sample can be analyzed. The use of the processor 168 to perform the transformation may provide the frequency domain data in real time or near real time.

The processor 168 can then be used to analyze the acoustic sample data in the frequency domain to obtain one or more of the frequency domain features and provide an output with the determined frequency domain features for further processing. In some embodiments, the output of the frequency domain features can include features that are not used to determine the presence of every event.

The output of the processor with the frequency domain features for the acoustic sample data can then be used to determine the presence of one or more events at one or more locations at the flow line 114 over which the acoustic data is acquired or filtered. In some embodiments, the determination of the presence of one or more events can include comparing the frequency domain features with the frequency domain feature thresholds or ranges in each event signature. When the frequency domain features in the acoustic sample data match one or more of the event signatures, the event can be identified as having occurred during the sample data measurement period, which can be in real time. Various outputs can be generated to display or indicate the presence of the one or more events.

The matching of the frequency domain features to the event signatures can be accomplished in a number of ways. In some embodiments, a direct matching of the frequency domain features to the event signature thresholds or ranges can be performed across a plurality of frequency domain features. In some embodiments, machine learning or even deterministic techniques may be incorporated to allow new signals to be patterned automatically based on the descriptors. As an example, k-means clustering and k-nearest neighbor classification techniques may be used to cluster the events and classify them to their nearest neighbor to offer exploratory diagnostics/surveillance capability for various events, and in some instances, to identify new downhole events that do not have established event signatures. The use of learning algorithms may also be useful when multiple events occur simultaneously such that the acoustic signals stack to form the resulting acoustic sample data.

In some embodiments, the frequency domain features can be used to determine the presence, type, size, composition, etc. of flow obstructions 310, 312 disposed within and/or passing through the flow line 114. The determination of a plurality of the frequency domain features (e.g., the spectral centroid, the spectral spread, alone or in combination with other frequency domain features), and the comparison with the thresholds may allow for a detection (which may include a characterization) of flow obstructions 310, 312 in the fluid at the selected point on the flow line 114.

As noted above, a plurality of frequency domain features can be calculated as part of the data processing routine. The comparison of the frequency domain features with the corresponding threshold can occur in any order. In some embodiments, one or more values can be calculated and compared to the corresponding threshold values or ranges to determine if flow obstructions are presented within the flow line 114 represented by the acoustic sample data. In other embodiments, the frequency domain features can be calculated sequentially. If the value of a first frequency domain feature is not above the corresponding threshold, the value for the portion 125 of the flow line 114 or point of interest of the flow line 114 represented by the acoustic sample data can be set to zero, and another sample can be processed. If the value of the frequency domain feature is greater than the corresponding threshold, then the next frequency domain feature can be determined and compared to the corresponding threshold. If the second comparison does not result in the property exceeding the threshold, the value for the portion 125 of the flow line 114 or point of interest of the flow line 114 represented by the acoustic sample data can be set to zero. This may result in a data point comprising a value of zero such that a resulting log may comprise a zero value at the corresponding portion 125 of the flow line 114 or point of interest of the flow line 114. If the second comparison indicates that the second frequency domain feature is greater than the corresponding threshold, then the presence of the event can be confirmed, or the next frequency domain feature can be calculated. This process can repeat for each frequency domain feature forming a part of the acoustic signature. Only when all of the relevant frequency domain features meet or exceed the corresponding threshold(s) would another value such as the energy or intensity value recorded on a data log for the well. The calculated values for the energy or intensity can be stored in the memory 170 for those acoustic sample data sets in location and time meeting or exceeding the corresponding thresholds, and a value of zero can be stored in the memory 170 for those acoustic sample data sets not meeting or exceeding one or more of the corresponding thresholds. When a model is used to determine the presence or absence of the flow obstruction event, a plurality of frequency domain features can be determined and then used with the models.

In some embodiments, flow obstructions, such as, for instance a flow line pig 312 being transported within the fluid in the flow line 114 can be characterized by a flow obstruction transport signature that comprises a plurality of frequency domain features. In some embodiments, the plurality of frequency domain features in the flow obstruction transport signature can comprise the spectral centroid threshold range and a spectral rolloff threshold, and the frequency domain features can include a spectral centroid and a spectral rolloff. The flow obstruction transport signature can be indicative of a flow obstruction (e.g., pig 312) progressing or moving within a the flow line 114. The processor 168, using the analysis application, can be configured to compare the plurality of spectral descriptor values to the thresholds and/or ranges and determine if the pig 312 is advancing within the flow line 114. The determination of the spectral descriptor values can be performed in any order, and the determination can be made sequentially (e.g., verifying a first frequency domain feature is within a threshold and/or range, followed by a second frequency domain feature, etc.), or in parallel using the frequency domain features in the event signature.

In addition to detecting the presence of one or more events (e.g., flow obstruction event(s)) at a portion 125 of the flow line 114 or at a point of interest of the flow line 114, the analysis software executing on the processor 168 can be used to visualize the event locations or transfer the calculated energy values over a computer network for visualization on a remote location. In order to visualize one or more of the events, the energy or intensity of the acoustic signal can be determined at the portion 125 of the flow line 114 or at a point of interest of the flow line 114.

The intensity of the acoustic signal in the filtered data set can then be calculated, where the intensity can represent the energy or power in the acoustic data. A number of power or intensity values can be calculated. In an embodiment, the root mean square (RMS) spectral energy or sub-band energy ratios across the filtered data set frequency bandwidth can be calculated at each of the identified event locations (e.g., portion 125 of the flow line 114 or at a point of interest of the flow line 114) over a set integration time to compute an integrated data trace of the acoustic energies over all or a portion of the length of the optical fiber 116 as a function of time. This computation of an event log may be done repeatedly, such as every second, and later integrated/averaged for discrete time periods—for instance, at times of higher well drawdowns, to display a time-lapsed event log at various stages of the production process (e.g., from baseline shut-in, from during well ramp-up, from steady production, from high drawdown/production rates etc.). The time intervals may be long enough to provide suitable data, though longer times may result in larger data sets. In an embodiment, the time integration may occur over a time period between about 0.1 seconds to about 10 seconds, or between about 0.5 seconds and about a few minutes or even hours.

The resulting event log(s) can be computed every second and can be stored in the memory 170 or transferred across a computer network, to populate an event database. The data stored/transferred in the memory 170 can include any of the frequency domain features, the filtered energy data set, and/or the RMS spectral energy through time, for one or more of the data set depths and may be stored every measurement period (e.g., every second, etc.). This data can be used to generate an integrated event log at each event sample point along the length of the optical fiber 116 along with a synchronized timestamp that indicates the times of measurement. In producing a visualization event log, the RMS spectral energy for sections that do not exhibit or match one or more event signatures can be set to zero. This allows those points or zones along the optical fiber 116 exhibiting or matching one or more of the event signatures to be easily identified.

As an example, the analysis software executing on the processor 168 can be used to visualize locations on the flow line 114 at which flow obstructions 310, 312 are present. The resulting values calculated energy values can be passed or transferred over a computer network for visualization on a remote location. In order to visualize the locations on the flow line 114 at which flow obstructions are present, the energy or intensity of the acoustic signal, or at least the high frequency portion of the acoustic signal, can be determined at the interval of interest (e.g., portion 125 of the flow line 114 or at a point of interest of the flow line 114).

When the spectral descriptors have values above the corresponding thresholds in the event signature, the acoustic sample data can be filtered to obtain the acoustic data associated with the particulates 302 flowing through the flow line 114 and/or impinging on an inner surface of the flow line. In some embodiments, only the acoustic sample data meeting or exceeding the corresponding thresholds may be further analyzed, and the remaining acoustic sample data can have the value set to zero. The acoustic sample data sets meeting or exceeding the corresponding thresholds can be filtered with a high frequency filter and/or a low frequency filter. In an embodiment, the acoustic sample data sets meeting or exceeding the corresponding thresholds can be filtered with a high frequency filter to remove the frequencies below about 0.5 kHz, below about 1 kHz, below about 1.5 kHz, or below about 2 kHz. The upper frequency range may be less than about 10 kHz, less than about 7 kHz, less than about 6 kHz, or less than about 5 kHz, where the filter bandwidth can have a frequency range between any of the lower values and any of the upper values. In an embodiment, the acoustic sample can be filtered to produce a filtered data set comprising the frequencies between about 0.5 kHz and about 10 kHz, or between about 2 kHz and about 5 kHz from the acoustic sample. The filtered data set allows the broad band acoustic energy in the higher frequencies to be isolated, and thereby allow the acoustics for flow obstruction events to be distinguished from the general, low frequency fluid flow noise captured by the acoustic sensor resulting from fluid flow and mechanical sources of acoustic signals.

The intensity of the acoustic signal in the filtered data set can then be calculated, where the intensity can represent the energy or power in the acoustic data. In some embodiments, the root mean square (RMS) spectral energy across the filtered data set frequency bandwidth can be calculated at each of the identified sections of the flow line 114 or optical fiber 116 over a set integration time to compute an integrated data trace of particulates 302 passing energies over all or a portion of the length of the optical fiber 116 as a function of time. This computation of a 'particulates log' may be done repeatedly, such as every second, and later integrated/averaged for discrete time periods, to display a time-lapsed particulates log. The time intervals may be long enough to provide suitable data, though longer times may result in larger data sets. In some embodiments, the time integration may occur over a time period between about 0.1 seconds to about 10 seconds, or between about 0.5 seconds and about a few minutes or even hours.

The data output by the system may generally indicate one or more flow obstruction locations along the flow line 114, and optionally, an indicator of the size, type, nature of a flow obstruction at particular locations within the flow line 114. If flow obstructions are identified and/or located within the flow line 114 (as determined by methods described herein and/or such as surface sand detectors, visual observation, etc.), various actions can be taken in order to mitigate the potential negative affects of the flow obstruction. In some embodiments, de-waxing or hydrate removal chemicals/solutions may be injected into the flow line 114 to reduce the size of or remove the identified flow obstruction(s) (that is when the flow obstruction comprise deposits of wax or hydrates). Data analysis can be performed on during and/or after the injection to determine the effectiveness the injection has on the flow obstruction(s).

In some embodiments, the event detection as described herein can be used to identify one or more events in place of or in addition to a flow obstruction event. For example, the event detection can be used to identify other events associated with the flow line such as rain, wind, transportation noise, equipment operating in the vicinity, valve noise, or any other acoustic signals associated with or incident upon the flow line. The resulting events can create acoustic sounds that can interfere with or otherwise affect the determination of a flow line event. When one or more additional events are determined, the additional events can be used in the determination of the presence of a flow obstruction event. For example, the additional event(s) can be used as part of the event signature matching or use in an event detection model. In some embodiments, the one or more additional events can be used to cancel portions of the acoustic signature associated with the one or more events to provide a filtered or modified acoustic signal to the event detection process for the flow obstruction event(s). This can provide an improved process for identifying the events. When one or more additional events are identified, the one or more additional events can be provided as an output, and can be used in decision making for the flow line.

In some embodiments, the location and or discrimination between events may not be clear. One or more characteristics of the flow line 114 can then be changed to allow a second measurement of the acoustic signal to occur. For example, the flow rate, flow composition, etc. through the flow line 114 can be changed. For example, the flow rate in the flow line can be temporarily increased or decreased. The resulting data analysis can be performed on the data during the increased or decreased production period, respectively. In general, an increased fluid flow rate into the flow line 114 may be expected to increase the acoustic signal intensity at certain event locations. This may allow a signal to noise ratio to be improved in order to more clearly identify one event relative to another at one or more locations by, for example, providing for an increased signal strength to allow the event signatures to be compared to the resulting acoustic signal. Any changes in the presence of the events over time can be monitored using the techniques described herein and the operating conditions can be adjusted accordingly (e.g., dynamically adjusted, automatically adjusted, manually adjusted, etc.). While the data analysis has been described above with respect to the monitoring system 100 and the methods of identifying events within the flow line 114, the data analysis described herein can also be carried out using any suitable system. For example, the system of FIG. 1 can be used to carry out the identification method, a separate system at a different time and/or location can be used with acoustic data to perform the event identification method, and/or the method can be performed using acoustic data obtained from a different type of acoustic sensor where the data is obtained in an electronic form usable with a device capable of performing the method.

Additional data processing techniques can also be used to detect events in the flow line 114. In some embodiments, the processor 168 can execute a program, which can configure the processor 168 to filter the acoustic data set spatially and spectrally to provide frequency band extracted (FBE) acoustic data over multiple frequency bands. This can be similar to the frequency bands described with respect to the RMS energies. The acoustic data set can be pre-processed and then frequency filtered in to multiple frequency bands at given intervals such as every second of data acquisition. The multiple frequency bands can include various ranges. As an example, the multiple frequency bands can include a first band from about 5 Hz to about 50 Hz; a second band from about 50 Hz to about 100 Hz; a third band from about 100 Hz to about 500 Hz; a fourth band from about 500 Hz to about 2000 Hz; a fifth band from about 2000 Hz to about 5000 Hz, and so on along the length of the optical fiber 116 or a selected portion thereof, though other ranges for the frequency bands can also be used.).

The resulting FBE data can then be cross compared to identify areas of the flow line 114 with event signatures corresponding to the FBE data. For example, the acoustic amplitudes in each of the multiple frequency bands can be compared to determine optical fiber 116 locations with response relative to a baseline acoustic signal. The baseline acoustic signal can be taken as the measured acoustics captured when flow obstructions 310, 312 are not present in the flow line 114. In an embodiment, the baseline acoustic signal can comprise a time averaged acoustic signal over one or more portions of the flow line 114. The time period for considering the average may be taken as long enough to avoid the potential of an event over the entire average. Any comparison of an acoustic signal comprising an event to the time average should then indicate an increased signal in at least one frequency ranges corresponding to the event frequency ranges of interest.

Using flow obstruction detection in a flow line as an example, additional data processing techniques can also be used to detect locations of flow obstruction within the flow line 114. The resulting FBE data can then be cross compared to identify areas of the flow line 114 with the signature of flow obstruction to compute a representative flow obstruction log. For example, the acoustic amplitudes in each of the multiple frequency bands can be compared to determine locations of the optical fiber 116 with broadband response (e.g., zones where a response in all of the bands is observed) relative to a baseline acoustic signal. The baseline acoustic signal can be taken as the measured acoustics captured when flow obstruction are not present the flow line 114. In an embodiment, the baseline acoustic signal can comprise a time averaged acoustic signal over one or more portions of the flow line 114. Any comparison of an acoustic signal comprising flow obstructions within the flow line 114 to the time average should then indicate an increased signal in at least one broadband frequency range (e.g., in a frequency range having a frequency greater than 0.5 kHz such as 0.5 kHz to about 5 kHz).

In addition to the systems described herein, various methods of determining the presence of one or more events can also be carried out. The methods can be performed using any of the systems described herein, or any other suitable systems. In an embodiment, a method of detecting an event within a flow line 114 can include obtaining a sample data set. The sample data set can be a sample of an acoustic signal originating within a flow line 114 comprising a fluid, and be representative of the acoustic signal across a frequency spectrum. A plurality of frequency domain features of the sample data set can be determined, and the plurality of spectral characteristics can be compared with corresponding threshold and/or ranges an event signature. When the plurality of frequency domain features match or sufficiently correspond with the event signature, the presence of the event within the flow line 114 can be determined based on the determination that that at least one spectral characteristic matches (or sufficient corresponds with) the event signature. The event signature can include any of those described herein, such as for formation, presence (including the presence of a particular size, composition, type, etc. of flow obstruction), or transport of a flow obstruction within a flow line 114.

In an embodiment, the method can be used to determine the presence and/or location of flow obstructions 310, 312 within the flow line 114 using a flow obstruction acoustic signature that comprises thresholds and/or ranges for a plurality of frequency domain features. The frequency domain features can include a plurality of the frequency domain features described herein (e.g., the spectral spread, the spectral roll-off, the spectral skewness, the root mean square (RMS) band energy (or the normalized sub-band energies/band energy ratios), a loudness or total RMS energy, a spectral flux, and/or a spectral autocorrelation function). The flow obstruction acoustic signature can be indicative of flow obstructions being present and/or moving within the flow line 114.

The embodiments disclosed herein are described as detecting acoustic signals describing a presence of flow obstructions in a flow line 114 and then performing computations on the acoustic signals to determine frequency data associated with the flow obstructions and the location of the flow line 114. However, it should be appreciated that the embodiments disclosed herein may be directed to detecting acoustic signals related to any solids or components that may be present in a flow line 114. For example, when the flow line is in the form of a pipeline, pipeline pigs that are used to clean or log a flow line 114 can be tracked within the flow line 114. In such a case, when the optical fiber 116 is coupled to the flow line 114, the optical fiber 116 may detect acoustic signals signaling the presence of the pipeline pig at a certain location along the flow line 114. Similarly, the optical fiber 116 may detect acoustic signals signaling the presence of any size object within the flow line 114, and frequency analysis may be performed on the acoustic signals to determine characteristics of the object identified within the flow line 114.

Figure 7:
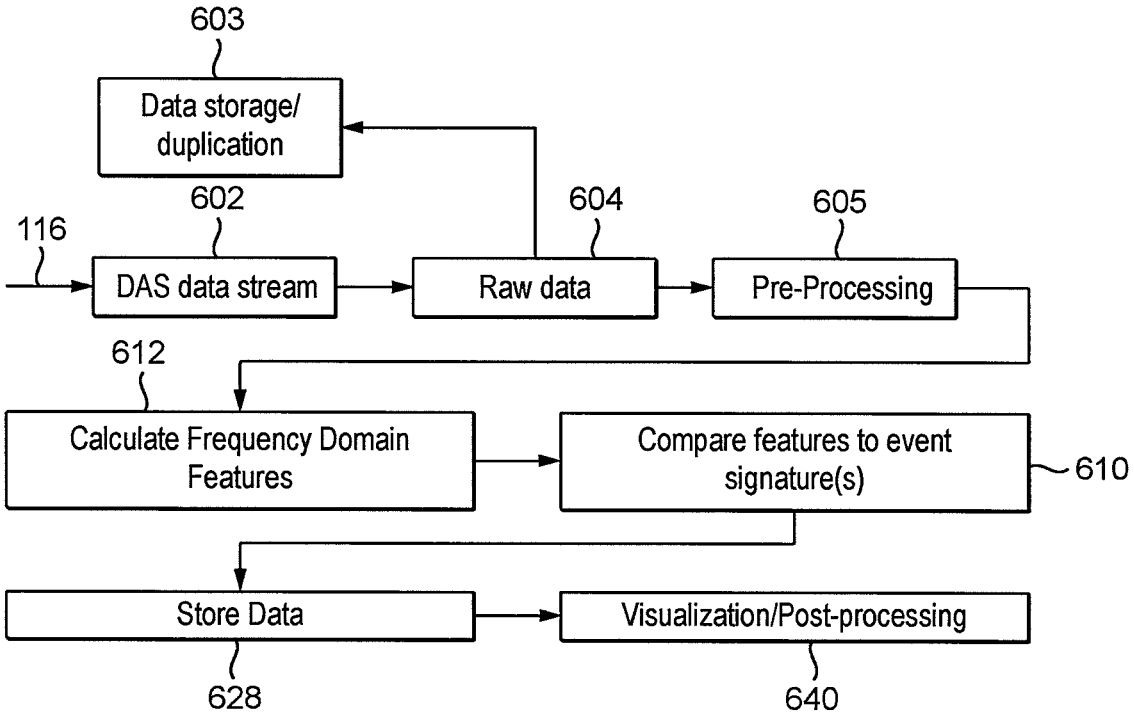
FIG. 7 schematically illustrates a flowchart of a method for detecting particulates passing through a flow line according to an embodiment.

The overall method and corresponding steps are schematically illustrated as a flowchart show in FIG. 7. As shown in FIG. 7, an embodiment of a method 600 for detecting flow obstructions within a flow line 114 can begin with an acoustic sensor such as a DAS system obtaining, detecting, or receiving an acoustic signal, for example, from an optical fiber 116, as shown in block 602. The acoustic signal can be generated within the flow line 114 as described herein. The raw optical data from the acoustic sensor can be received and generated by the sensor to produce the acoustic signal, as shown in block 604. The data rate generated by various acoustic sensors such as the DAS system can be large. This raw data can optionally be stored in a memory in block 603.

The raw data can then be optionally pre-processed in block 605. As shown in FIG. 7, the pre-processing can be performed using a number of optional steps. For example, a spatial sample point filter can be applied to the data. This filter uses a filter to obtain a portion of the acoustic signal corresponding to a desired location of the flow line 114. Since the time the light pulse sent into the optical fiber returns as backscattered light can correspond to the travel distance, and therefore a location of the flow line 114, the acoustic data can be processed to obtain a sample indicative of the desired location on the flow line 114. This may allow a specific location within the flow line 114 to be isolated for further analysis. The pre-processing step may also include removal of spurious back reflection type noises at specific depths through spatial median filtering or spatial averaging techniques.

In order to spatially filter the data, an initial spatial calibration can be performed in some embodiments. In these embodiments, one or more acoustic signals can be created and correlated to a specific location on the flow line 114. The resulting acoustic signal can be used to then correlate the position on the optical fiber 116 with the physical location on the flow line 114. For example, a point source such as a tap on the flow line 114 and/or the optical fiber 116 itself (e.g., a "tap test") can be generated at a known point on the flow line. The data processing of the acoustic signal from the optical fiber can be used to identify the location along the length of the fiber, and the known position on the flow line 114 an be recorded. The system can store the resulting optical fiber length measurements and flow line locations in memory to provide a correlation (e.g., a lookup table, etc.) between the acoustic signal results from the optical fiber and the position on the flow line of the tap. The results of the tap test can then be used throughout the remainder of the process including in the data visualization step as well as the optional spatial filtering block 606.

In some embodiments, the filtered data can be transformed from the time domain into the frequency domain using a transform such as a Fourier transform (e.g., a Short time Fourier Transform or through Discrete Fourier transformation) as part of the pre-processing at block 605. By transforming the data after applying the spatial filter, the amount of data processed in the transform can be reduced.

As part of the pre-processing at block 605, a noise normalization routine can optionally be performed on the data to improve the signal quality. This step can vary depending on the type of acquisition device 118 used as well as the configuration of the light source, the sensor, and the other processing routines. While a number of pre-processing steps are described, the order of the steps within the pre-processing routines can be varied, and any order of the optional steps can be used.

After the acoustic signal is pre-processed, the sample data set can be used to detect the presence of one or more events within the wellbore. The event detection process can include first determining at least one frequency domain feature in block 612. The event detection process or routine can determine all or a portion of the frequency domain features in block 612. In some embodiments, the frequency domain features can be determined sequentially. This process can include determining a first frequency domain feature (e.g., the spectral centroid of the sample data set, the spectral spread, etc.). The first frequency domain feature can then be compared against a first frequency domain feature threshold in the comparison at block 610. When the first frequency domain feature satisfies the first frequency domain feature threshold, the process can proceed to the next comparison.

A second frequency domain feature (e.g., a spectral spread, etc.) for the sample data set can then be determined. The second frequency domain feature can then be compared to a second frequency domain feature threshold in block 610. When the second frequency domain feature meets or satisfies the second frequency domain feature threshold, the process can proceed to the next frequency domain feature. This process can be repeated for each frequency domain feature, or derived value (e.g., a combination of frequency domain features) forming a portion of the event signature. When the sample data set has the corresponding frequency domain features above the corresponding threshold for a flow obstruction event signature, it can be determined that the acoustic data at the location of the flow line 114 represented by the sample data set represents a flow obstruction present in the flow line 114. Additional frequency domain features can also be determined and compared to corresponding thresholds as defined by each acoustic signature. This can include the location, size, composition, type, etc. of flow obstruction within flow line 114.

It can be noted that if any of the comparisons at block 610 between the sequentially determined frequency domain features and the corresponding frequency domain feature thresholds results in any determined frequency domain feature being below the corresponding threshold, the process may set a value (or all values) for the sample data set to zero for that location before allowing the process to proceed to the data integration and storage routine in block 628. The spectral conformance checks can occur in any order, and the serial comparisons may allow those sample data sets that fail the first comparison of either the spectral centroid or the spectral spread to proceed to the post-processing routine without the need to pass through the remaining elements of the spectral conformance process or routine.

As an alternative to a sequential process, a plurality of frequency domain features can be determined in block 612. This can include those frequency domain features used for comparing against one or more event thresholds. In some embodiments, additional frequency domain features can also be determined as part of the processing. The additional frequency domain features can be used for later comparisons or determinations of new signatures. The determination of a plurality of frequency domain features can still result in a data reduction over the amount of data compared to the raw data measurements.

In the comparison at block 610, the sample data set can optionally be further processed to allow for the determination of a type/size/composition/etc. of the flow obstruction within the flow line 114. In some embodiments, the sample data set can be optionally filtered to isolate a portion of the acoustic data. The sample data set can be filtered within a predefined frequency range to produce a second data set. In an embodiment, the sample data set can be filtered in a bandwidth as described herein. The frequency filter may isolate the acoustic signature of the flow obstruction within the flow line 114 while removing the lower frequency portions attributable to fluid 306 flow and other potential acoustic sources. The resulting second data set can then be processed to compute the spectral energy of the second data set. In an embodiment, the spectral energy can be calculated as the root mean square spectral energy of the second data set. The spectral energy can represent the power or energy of the acoustic signal over the time period at the location of the flow line 114 represented by the second data set. The value of the determined spectral energy can then be stored in a memory as being associated with the location of the flow line 114 at the time of collection of the acoustic signal.

The processing signal can then be passed to the data storage and integration processing in block 628. In general, the processing steps determine the presence of flow obstructions within the flow line 114 at a location of the flow line 114 represented by the sample data set. In order to obtain an analysis along the length of the flow line 114, the processing steps between the data pre-processing steps and the comparison process can be repeated for a plurality of sample data sets representing various points, sections, or regions along the flow line 114. As the data is analyzed, the resulting information can pass to the data storage and integration routine in step 628 to be integrated into a flow obstruction log representing the results along the length of the flow line 114 and at the bends 120 of the flow line 114 for a given time period. When the data is analyzed along the length of the flow line 114 of the flow line 114 for all of the data set, the process can begin again for the next time period in order to analyze the data along the length of the flow line 114 for the subsequent time period. This process can then be repeated as needed to track the flow obstructions (e.g., such as in the case of flow line pigs 312) flowing through the flow line 114 over time.

In the data storage and integration process of block 628, the data from each analysis can be received and used to update an event database. The data can also be sent to another database and/or the event database can be located remotely from the processing location. The data can then be further analyzed for data integration and visualization in near real time or at any later time. The data can include the calculated frequency domain features, or a zero value when the frequency domain features are below the corresponding thresholds of the corresponding event signature or event signatures used for comparison, the depth associated with the sample data set, a time associated with the acoustic signal acquisition, or any combination thereof. In some embodiments, the values of the frequency domain features can be retained in the data even if the comparison with the event signatures does not indicate a match. The data from a plurality of analysis can then be stored in an event database or log for further use.

The data stored in the data integration process can be passed to the data visualization process in block 640. In this process, a number of logs can be created to allow for the visualization and/or representation of the flow obstructions 310, 312 in the flow line 114. In an embodiment, the data, which can optionally be integrated in the data integration routine in block 628 but does not have to be integrated, can be passed to the data visualization process at block 640. In the data visualization process, the spectral energy calculated for a sample data set can be analyzed to determine if the spectral energy value is greater than zero. In this instance, a zero or null value can be used to indicate that flow obstructions are not present at a location within the flow line (or at least not present at detectable levels).

When a zero value is detected, the process can proceed to a step, where a zero is entered along a well schematic or representation to indicate that flow obstructions are not detected within the flow line 114 at the location of the flow line 114 represented by the sample data set. When the spectral energy value is not zero, a visual representation of the spectral energy can be associated with a corresponding location of the flow line 114. The visual representation can be displayed as part of the visualization process. The process can be repeated in order to process a subsequent data set or another entry in an integrated log. Once all of the data sets and/or entries in the integrated log have been processed, a complete visual representation of flow obstructions 310, 312 locations along the length of the flow line 114 can be presented for a given time. This process can be repeated over a plurality of times to provide and display a real time or near real time representation of flow obstructions 310, 312 present along the length of the flow line 114.

The visualization process at block 640 can also include the generation and display of a flow obstruction presence log or 'flow obstruction log'. The flow obstruction log generally represents the total acoustic power or spectral energy caused by flow obstruction on one axis and a location of the flow line 114 represented by the sample data set on another axis. This log can be obtained using the integrated log data from the data integration routine in block 628 and/or individual data sets can be iteratively analyzed to create the integrated flow obstruction log. In this embodiment, the locations at which no flow obstruction is detected can have a spectral energy set to zero. The integrated flow obstruction log can be displayed on a display to provide a representation of the locations on the flow line 114 having flow obstruction 310, 312. A plurality of flow obstruction logs can be created for different acoustic data collection times in order to provide and display multiple flow obstruction logs in real time or near real time for varying production settings.

Figure 8:
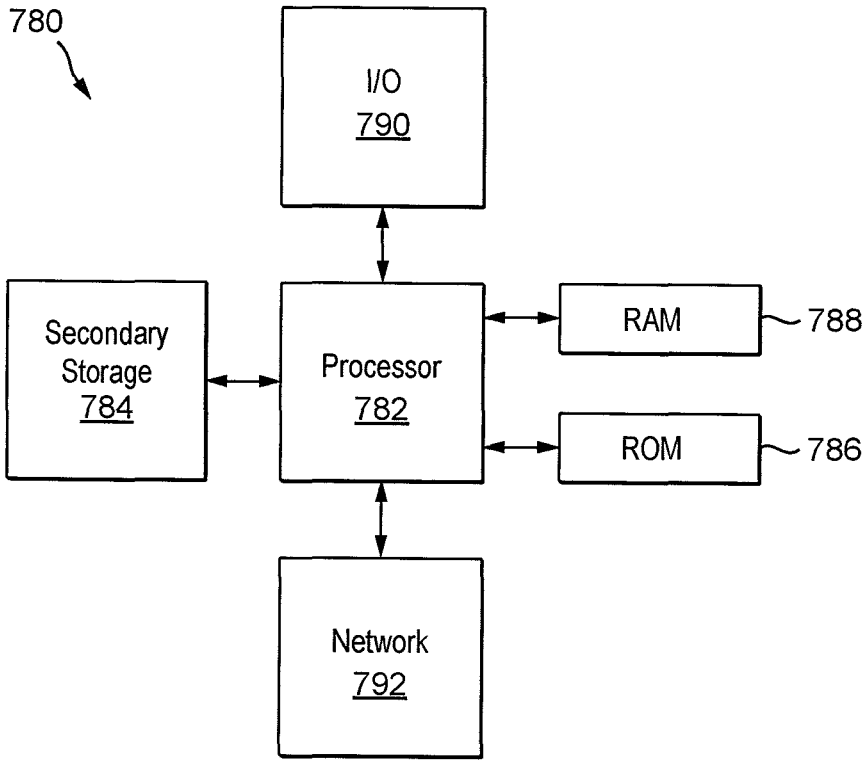
FIG. 8 schematically illustrates a computer that can be used to carry out various steps according to an embodiment.

Any of the systems and methods disclosed herein can be carried out on a computer or other device comprising a processor, such as the acquisition device 118 of FIG. 1. FIG. 8 illustrates a computer system 780 suitable for implementing one or more embodiments disclosed herein such as the acquisition device or any portion thereof. The computer system 780 includes a processor 782 (which may be referred to as a central processor unit or CPU) that is in communication with memory devices including secondary storage 784, read only memory (ROM) 786, random access memory (RAM) 788, input/output (I/O) devices 790, and network connectivity devices 792. The processor 782 may be implemented as one or more CPU chips.

It is understood that by programming and/or loading executable instructions onto the computer system 780, at least one of the CPU 782, the RAM 788, and the ROM 786 are changed, transforming the computer system 780 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the system 780 is turned on or booted, the CPU 782 may execute a computer program or application. For example, the CPU 782 may execute software or firmware stored in the ROM 786 or stored in the RAM 788. In some cases, on boot and/or when the application is initiated, the CPU 782 may copy the application or portions of the application from the secondary storage 784 to the RAM 788 or to memory space within the CPU 782 itself, and the CPU 782 may then execute instructions that the application is comprised of In some cases, the CPU 782 may copy the application or portions of the application from memory accessed via the network connectivity devices 792 or via the I/O devices 790 to the RAM 788 or to memory space within the CPU 782, and the CPU 782 may then execute instructions that the application is comprised of. During execution, an application may load instructions into the CPU 782, for example load some of the instructions of the application into a cache of the CPU 782. In some contexts, an application that is executed may be said to configure the CPU 782 to do something, e.g., to configure the CPU 782 to perform the function or functions promoted by the subject application. When the CPU 782 is configured in this way by the application, the CPU 782 becomes a specific purpose computer or a specific purpose machine.

The secondary storage 784 is typically comprised of one or more disk drives or tape drives and is used for non-volatile storage of data and as an over-flow data storage device if RAM 788 is not large enough to hold all working data. Secondary storage 784 may be used to store programs which are loaded into RAM 788 when such programs are selected for execution. The ROM 786 is used to store instructions and perhaps data which are read during program execution. ROM 786 is a non-volatile memory device which typically has a small memory capacity relative to the larger memory capacity of secondary storage 784. The RAM 788 is used to store volatile data and perhaps to store instructions. Access to both ROM 786 and RAM 788 is typically faster than to secondary storage 784. The secondary storage 784, the RAM 788, and/or the ROM 786 may be referred to in some contexts as computer readable storage media and/or non-transitory computer readable media.

I/O devices 790 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 792 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards that promote radio communications using protocols such as code division multiple access (CDMA), global system for mobile communications (GSM), long-term evolution (LTE), worldwide interoperability for microwave access (WiMAX), near field communications (NFC), radio frequency identity (RFID), and/or other air interface protocol radio transceiver cards, and other well-known network devices. These network connectivity devices 792 may enable the processor 782 to communicate with the Internet or one or more intranets. With such a network connection, it is contemplated that the processor 782 might receive information from the network, or might output information to the network (e.g., to an event database) in the course of performing the above-described method steps. Such information, which is often represented as a sequence of instructions to be executed using processor 782, may be received from and outputted to the network, for example, in the form of a computer data signal embodied in a carrier wave.

Such information, which may include data or instructions to be executed using processor 782 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well-known to one skilled in the art. The baseband signal and/or signal embedded in the carrier wave may be referred to in some contexts as a transitory signal.

The processor 782 executes instructions, codes, computer programs, scripts which it accesses from hard disk, floppy disk, optical disk (these various disk based systems may all be considered secondary storage 784), flash drive, ROM 786, RAM 788, or the network connectivity devices 792. While only one processor 782 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 784, for example, hard drives, floppy disks, optical disks, and/or other device, the ROM 786, and/or the RAM 788 may be referred to in some contexts as non-transitory instructions and/or non-transitory information.

In an embodiment, the computer system 780 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 780 to provide the functionality of a number of servers that is not directly bound to the number of computers in the computer system 780. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 780, at least portions of the contents of the computer program product to the secondary storage 784, to the ROM 786, to the RAM 788, and/or to other non-volatile memory and volatile memory of the computer system 780. The processor 782 may process the executable instructions and/or data structures in part by directly accessing the computer program product, for example by reading from a CD-ROM disk inserted into a disk drive peripheral of the computer system 780. Alternatively, the processor 782 may process the executable instructions and/or data structures by remotely accessing the computer program product, for example by downloading the executable instructions and/or data structures from a remote server through the network connectivity devices 792. The computer program product may comprise instructions that promote the loading and/or copying of data, data structures, files, and/or executable instructions to the secondary storage 784, to the ROM 786, to the RAM 788, and/or to other non-volatile memory and volatile memory of the computer system 780.

In some contexts, the secondary storage 784, the ROM 786, and the RAM 788 may be referred to as a non-transitory computer readable medium or a computer readable storage media. A dynamic RAM embodiment of the RAM 788, likewise, may be referred to as a non-transitory computer readable medium in that while the dynamic RAM receives electrical power and is operated in accordance with its design, for example during a period of time during which the computer system 780 is turned on and operational, the dynamic RAM stores information that is written to it. Similarly, the processor 782 may comprise an internal RAM, an internal ROM, a cache memory, and/or other internal non-transitory storage blocks, sections, or components that may be referred to in some contexts as non-transitory computer readable media or computer readable storage media.

Having described various systems and methods herein, specific embodiments can include, but are not limited to:

In a first embodiment, a monitoring system comprises: a flow line; an optical fiber coupled to the flow line; a receiver coupled to an end of the optical fiber, wherein the receiver is configured to detect an acoustic signal from the optical fiber; and a processor unit comprising a processor and a memory, wherein the processor unit is adapted for signal communication with the receiver, and wherein the memory comprises an analysis application, that when executed on the processor, configures the processor to: receive, from the receiver, the acoustic signal, wherein the acoustic signal is created by a fluid within the flow line, wherein the acoustic signal comprises a plurality of frequency domain features that are indicative of the acoustic signal across a frequency spectrum; detect a flow obstruction within the flow line based on the plurality of frequency domain features; and generate an output of the flow obstruction detection.

A second embodiment can include the system of the first embodiment, wherein the processor is configured to: compare the plurality of frequency domain features with a flow obstruction event signature, wherein the flow obstruction event signature comprises thresholds or ranges for one or more of the plurality of frequency domain features, and wherein the detection of the flow obstruction is based on the plurality of frequency domain features and the flow obstruction event signature.

A third embodiment can include the system of the first embodiment, wherein the processor is configured to detect the flow obstruction using the plurality of frequency domain features in a flow obstruction model.

A fourth embodiment can include the system of any one of the first to third embodiments, wherein the flow obstruction comprises a flow line pig, and wherein the analysis application, when executed on the processor, configures the processor to determine a location of the flow line pig within the flow line based on the plurality of frequency domain features.

A fifth embodiment can include the system of any one of the first to third embodiments, wherein the flow obstruction comprises a deposit of particulates within the flow line, and wherein the analysis application, when executed on the processor, configures the processor to determine a location of the deposit within the flow line based on the plurality of frequency domain features.

A sixth embodiment can include the system of any one of the first to third embodiments, wherein the deposit of particulates comprises at least one of wax, hydrate, or asphaltene, and wherein the analysis application, when executed on the processor, configures the processor to determine a location of the deposit within the flow line based on the plurality of frequency domain features.

A seventh embodiment can include the system of any one of the first to sixth embodiments, wherein the optical fiber is coupled to an exterior of the flow line.

An eighth embodiment can include the system of any one of the first to seventh embodiments, wherein the processor is configured to: detect one or more additional events associated with the flow line based on the plurality of frequency domain features, wherein the detection of the flow obstruction within the flow line is further based on the detection of the one or more additional events.

In a ninth embodiment, a method of detecting a flow obstruction in a flow line comprises: generating an acoustic signal within a flow line, wherein the acoustic signal is generated while a fluid is flowing within the flow line, and wherein the acoustic signal is generated from the fluid encountering the flow obstruction within the flow line; detecting the acoustic signal using an optical fiber coupled to the flow line; determining a plurality of frequency domain features from the acoustic signal; and detecting the flow obstruction in the flow line using the plurality of frequency domain features.

A tenth embodiment can include the method of the ninth embodiment, wherein detecting the flow obstruction comprises determining a location of the flow obstruction within the flow line using the acoustic signal.

An eleventh embodiment can include the method of the ninth or tenth embodiment, wherein the flow obstruction comprises a flow line pig, and wherein detecting the flow obstruction comprises tracking a position of the flow line pig within the flow line using the acoustic signal.

A twelfth embodiment can include the method of the ninth or tenth embodiment, wherein the flow obstruction comprises a deposit of particulates, and wherein the method comprises determining the composition of the deposit using the acoustic signal.

A thirteenth embodiment can include the method of the twelfth embodiment, wherein the deposit of particulates comprises at least one of wax, hydrate, or asphaltene.

A fourteenth embodiment can include the method of any one of the ninth to thirteenth embodiments, wherein the optical fiber is coupled to a receiver, wherein detecting the flow obstruction in the flow line comprises: receiving, from the receiver, the acoustic signal, wherein the acoustic signal comprises the plurality of frequency domain features that are indicative of the acoustic signal across a frequency spectrum; comparing the plurality of frequency domain features with a flow obstruction event signature that comprises thresholds or ranges for one or more of the plurality of frequency domain features; detecting the flow obstruction based on the comparing; and generating an output of the flow obstruction detection.

A fifteenth embodiment can include the method of the fourteenth embodiment, comprising identifying a location of the flow obstruction within the flow line via the output.

A sixteenth embodiment can include the method of any one of the ninth to fifteenth embodiments, further comprising: detecting one or more additional events associated with the flow line based on the plurality of frequency domain features, wherein detecting the flow obstruction in the flow line is further based on detecting the one or more additional events.

In a seventeenth embodiment, a method of developing a model for detecting a flow obstruction within a flow line comprises: obtaining a plurality of reference data sets for a flow line, wherein the plurality of reference data sets comprise acoustic data obtained across a frequency spectrum, wherein the acoustic data is obtained from one or more sensors coupled to at least a portion of the flow line, wherein the plurality of reference data sets comprise at least one reference data set obtained when a flow obstruction is present within the flow line and at least one reference data set obtained when the flow obstruction is absent from the flow line; determining one or more frequency domain features from the reference data sets; and training a model using the one or more frequency domain features from at least a portion of the reference data sets.

An eighteenth embodiment can include the method of the seventeenth embodiment, wherein the model is trained using a first portion of the reference data sets, and wherein the method further comprises: validating the model using a second portion of the reference data sets.

A nineteenth embodiment can include the method of the seventeenth or eighteenth embodiment, wherein the model comprises a logistic regression model, and wherein training the model comprises: providing the one or more frequency domain features to the logistic regression model corresponding to one or more reference data sets of the plurality of reference data sets where the flow of obstruction is present within the flow line; providing the one or more frequency domain features to the logistic regression model corresponding to one or more reference data sets of the plurality of reference data sets where the flow of obstruction is absent the flow line; and determining a first multivariate model using the one or more frequency domain features as inputs, wherein the first multivariate model defines a relationship between a presence and an absence of the flow obstruction in the flow line.

A twentieth embodiment can include the method of any one of the seventeenth to nineteenth embodiments, wherein the model is a supervised learning algorithm.

A twenty first embodiment can include the method of any one of the seventeenth to nineteenth embodiments, wherein the one or more sensors comprises a fiber optic cable coupled to the flow line.

A twenty second embodiment can include the method of the twenty first embodiment, wherein the fiber optic cable is disposed along the length of the flow line, and wherein the acoustic data is indicative of an acoustic signal originated within the flow line. While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification. Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit in this disclosure or any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art. Neither is the "Summary" to be considered as a limiting characterization any pending or issued claims. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

I claim:

1. A monitoring system, comprising:

a flow line;

an optical fiber coupled to the flow line;

a receiver coupled to an end of the optical fiber, wherein the receiver is configured to detect an acoustic signal from the optical fiber, wherein the acoustic signal is created by a fluid within the flow line, and wherein the acoustic signal is a time domain signal taken across a frequency range; and a processor unit comprising a processor and a memory, wherein the processor unit is adapted for signal communication with the receiver, and wherein the memory comprises an analysis application, that when executed on the processor, configures the processor to:

receive, from the receiver, the acoustic signal, convert the time domain signal to a frequency domain representation of the time domain signal to form a frequency domain signal, and determine a plurality of frequency domain features from the frequency domain signal, wherein each frequency domain feature of the plurality of frequency domain features is a characteristic representative of the frequency domain signal;

detect a flow obstruction within the flow line based on the plurality of frequency domain features; and generate an output of the flow obstruction detection.

2. The system of claim 1, wherein the processor is configured to:

compare the plurality of frequency domain features with a flow obstruction event signature, wherein the flow obstruction event signature comprises thresholds or ranges for one or more of the plurality of frequency domain features, and wherein the detection of the flow obstruction is based on the plurality of frequency domain features and the flow obstruction event signature.

3. The system of claim 1, wherein the processor is configured to detect the flow obstruction using the plurality of frequency domain features in a flow obstruction model.

4. The system of claim 1, wherein the flow obstruction comprises a flow line pig, and wherein the analysis application, when executed on the processor, configures the processor to determine a location of the flow line pig within the flow line based on the plurality of frequency domain features.

5. The system of claim 1, wherein the flow obstruction comprises a deposit of particulates within the flow line, and wherein the analysis application, when executed on the processor, configures the processor to determine a location of the deposit within the flow line based on the plurality of frequency domain features.

6. The system of claim 5, wherein the deposit of particulates comprises at least one of wax, hydrate, or asphaltene, and wherein the analysis application, when executed on the processor, configures the processor to determine a location of the deposit within the flow line based on the plurality of frequency domain features.

7. The system of claim 1, wherein the optical fiber is coupled to an exterior of the flow line.

8. The system of claim 1, wherein the processor is configured to:

detect one or more additional events associated with the flow line based on the plurality of frequency domain features, wherein the detection of the flow obstruction within the flow line is further based on the detection of the one or more additional events.

9. The system of claim 1, wherein the plurality of frequency domain features comprise a spectral centroid, a spectral spread, a spectral roll-off, a spectral skewness, an RMS band energy, a total RMS energy, a spectral flatness, a spectral slope, a spectral kurtosis, a spectral flux, a spectral autocorrelation function, a normalized variant thereof, a transformation thereof, and/or a combination thereof.

10. A method of detecting a flow obstruction in a flow line, the method comprising:

generating an acoustic signal within a flow line, wherein the acoustic signal is generated while a fluid is flowing within the flow line, and wherein the acoustic signal is generated from the fluid encountering the flow obstruction within the flow line, and wherein the acoustic signal is a time domain signal taken across a frequency range;

detecting the acoustic signal using an optical fiber coupled to the flow line;

converting the time domain signal to a frequency domain representation of the time domain signal to form a frequency domain signal, determining a plurality of frequency domain features from the frequency domain signal, wherein each frequency domain feature of the plurality of frequency domain features is a characteristic representative of the frequency domain signal; and detecting the flow obstruction in the flow line using the plurality of frequency domain features.

11. The method of claim 10, wherein detecting the flow obstruction comprises determining a location of the flow obstruction within the flow line using the acoustic signal.

12. The method of claim 10, wherein the flow obstruction comprises a flow line pig, and wherein detecting the flow obstruction comprises tracking a position of the flow line pig within the flow line using the acoustic signal.

13. The method of claim 10, wherein the flow obstruction comprises a deposit of particulates, and wherein the method comprises determining the composition of the deposit using the acoustic signal.

14. The method of claim 13, wherein the deposit of particulates comprises at least one of wax, hydrate, or asphaltene.

15. The method of claim 10, wherein the optical fiber is coupled to a receiver, wherein detecting the flow obstruction in the flow line comprises:

receiving, from the receiver, the acoustic signal, wherein the acoustic signal comprises the plurality of frequency domain features that are indicative of the acoustic signal across a frequency spectrum;

comparing the plurality of frequency domain features with a flow obstruction event signature that comprises thresholds or ranges for one or more of the plurality of frequency domain features;

detecting the flow obstruction based on the comparing; and generating an output of the flow obstruction detection.

16. The method of claim 15, comprising identifying a location of the flow obstruction within the flow line via the output.

17. The method of claim 10, further comprising:

detecting one or more additional events associated with the flow line based on the plurality of frequency domain features, wherein detecting the flow obstruction in the flow line is further based on detecting the one or more additional events.

* * * * *